US007201213B2

(12) United States Patent
Leeson et al.

(10) Patent No.: US 7,201,213 B2
(45) **Date of Patent: *Apr. 10, 2007**

(54) KEEL COOLER WITH FLUID FLOW DIVERTER

(75) Inventors: Jeffrey S. Leeson, South Euclid, OH (US); Michael W. Brakey, Shaker Heights, OH (US); P. Charles Miller, Jr., Novelty, OH (US)

(73) Assignee: Duramax Marine, LLC, Hiram, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/134,892

(22) Filed: May 23, 2005

(65) Prior Publication Data

US 2005/0205237 A1 Sep. 22, 2005

Related U.S. Application Data

(62) Division of application No. 10/282,571, filed on Oct. 29, 2002, now Pat. No. 6,896,037.

(51) Int. Cl.

| | |
|---|---|
| ***B63H 21/10*** | (2006.01) |
| ***F28D 1/00*** | (2006.01) |
| ***F28D 1/02*** | (2006.01) |
| ***F28D 1/04*** | (2006.01) |

(52) U.S. Cl. ..... 165/44; 165/41; 165/174; 165/173; 440/88 C; 440/88 HE; 440/88 R

(58) Field of Classification Search ..... 165/41, 165/44, 174, 173, 175, DIG. 483, 149; 440/88 C, 440/88 HE, 88 R See application file for complete search history.

(56) References Cited

U.S. PATENT DOCUMENTS

| | | | | |
|---|---|---|---|---|
| 673,767 | A * | 5/1901 | Eycleshymer | 165/DIG. 483 |
| 1,124,740 | A * | 1/1915 | Holt | 165/174 |
| 1,344,351 | A * | 6/1920 | Norelius et al. | 165/149 |
| 1,484,749 | A * | 2/1924 | Yeager | 165/174 |
| 1,486,556 | A * | 3/1924 | Witte | 165/DIG. 483 |
| 1,838,722 | A | 12/1931 | Watson | |
| 2,382,218 | A | 8/1945 | Fernstrum | |
| 2,415,154 | A | 2/1947 | Walter | |
| 2,488,623 | A * | 11/1949 | Goeltz | 165/175 |
| 3,177,936 | A | 4/1965 | Walter | |
| 3,240,179 | A | 3/1966 | Van Ranst | |
| 4,338,993 | A | 7/1982 | Fernstrum | |
| 4,484,622 | A | 11/1984 | Satchwell | |

(Continued)

FOREIGN PATENT DOCUMENTS

| | | | |
|---|---|---|---|
| WO | WO 01/31264 | A | 5/2001 |
| WO | WO 01/31264 | A2 * | 5/2001 |
| WO | WO 03/087691 | A | 10/2003 |

*Primary Examiner*—John K. Ford
(74) *Attorney, Agent, or Firm*—D. Peter Hochberg; Sean Mellino

(57) ABSTRACT

A keel cooler having a standard header with an internal beveled bottom wall, with orifices on the inner wall of the exterior tubes extending into the header, the orifices being in the natural flow path of the coolant flow. The orifices are sufficiently large so as not to restrict the flow of coolant. A fluid flow diverter is additionally provided in the header of the keel cooler for facilitating coolant flow towards both the interior tubes and also towards the exterior tubes.

11 Claims, 18 Drawing Sheets

U.S. PATENT DOCUMENTS

| | | | | |
|---|---|---|---|---|
| 4,557,319 | A | 12/1985 | Arnold | |
| 4,596,287 | A | 6/1986 | Wissmath | |
| 5,299,635 | A | 4/1994 | Abraham | |
| 5,529,117 | A | 6/1996 | Voss et al. | |
| 5,931,217 | A | 8/1999 | Fernstrum | |
| 6,099,373 | A | 8/2000 | Fernstrum | |
| 6,116,335 | A * | 9/2000 | Beamer et al. | 165/175 |
| 6,575,227 | B1 | 6/2003 | Leeson et al. | |
| 2002/0162643 | A1 | 11/2002 | Leeson et al. | |
| 2003/0098141 | A1 | 5/2003 | Fernstrum | |

* cited by examiner

KEEL COOLER WITH FLUID FLOW DIVERTER

CROSS-REFERENCE TO RELATED APPLICATION

This application is a division of U.S. patent application Ser. No. 10/282,571 filed Oct. 29, 2002 now U.S. Pat. No. 6,896,037.

FIELD OF THE INVENTION

The present invention relates generally to heat exchangers. More particularly, the present invention relates to heat exchangers for cooling engines, generators, gear boxes and other heat generating sources in industrial apparatuses having fluid cooled heat sources, such as marine vessels. The invention more particularly relates to open heat exchangers (where heat transfer tubes are exposed to the ambient cooling or heating fluid, rather than being a tube in shell type of device) used for cooling heat sources, where the heat exchangers are more efficient, and thus have lower weight and volume compared to other heat exchangers known in the art. Alternatively, the heat exchanger according to the present invention could be used as a heater, wherein relatively cool fluid absorbs heat through the heat transfer tubes.

DESCRIPTION OF THE PRIOR ART

Heat generating sources in industrial applications, such as marine Vessels, are often cooled by water, other fluids or water mixed with other fluids. For example, in marine vessels used in fresh water and/or salt water, the cooling fluid or coolant flows through the engine or other heat generating source where the coolant picks up heat, and then flows to another part of the plumbing circuit. The heat must be transferred from the coolant to the ambient surroundings, such as the body of water in which the vessel is located. For relatively small engines, such as outboard motors for small boats, ambient water pumped through the engine is a sufficient coolant. However, as the vessel power demand gets larger, ambient water pumped through the engine may continue to provide good cooling of the engine, but also can serve as a source of significant contamination damage to the engine. If raw, ambient water were used to cool the engine, the ambient water would carry debris and, particularly if it is salt water, corrosive chemicals to the engine. Therefore, various apparatuses for cooling engines and other heat sources have been developed.

One such apparatus for cooling the engine of a vessel is channel steel, which is essentially a large quantity of shaped steel that is welded to the bottom of the hull of a vessel for conveying engine coolant and transferring heat from the coolant to the ambient water. There are many severe limitations with channel steel. For example, it is very inefficient, requiring a large amount of steel in order to obtain the required cooling effect; it is very expensive to attach to a vessel since it must be welded to the hull, which is a very labor intensive operation; because channel steel is very heavy, the engine must be large enough to carry the channel steel, rendering both the initial equipment costs and the operating costs very high; the larger, more powerful engines of today are required to carry added channel steel for their cooling capacity with only limited room on the hull to carry it; the payload capacity is decreased; the large amount of channel steel is expensive; the volume of the cooling system is increased, thereby increasing the cost of coolants employed in the system, such as anti-freeze; and finally, channel steel is inadequate for the present and future demands for cooling modern day marine vessels. Even though channel steel is the most widely used heat exchanger for vessels, segments of the marine industry are abandoning channel steel and using smaller keel coolers for new construction to overcome the limitations cited earlier.

A keel cooler was developed in the 1940's and is described in U.S. Pat. No. 2,382,218 (Fernstrum). The Fernstrum patent describes a heat exchanger for attachment to a marine hull structure which is composed of a pair of spaced headers secured to the hull, and a plurality of heat conduction tubes, each of whose cross-section is rectangular, which extend between the headers. Cylindrical plumbing through the hull connects the headers to coolant flow lines extending from the engine or other heat source. Hot coolant leaves the engine, and runs into a heat exchanger header located beneath the water level (the water level refers to the water level preferably below the aerated water, i.e. below the level where foam and bubbles occur), either beneath the hull or on at least one of the lower sides of the hull. The coolant then flows through the respective rectangular heat conduction tubes and goes to the opposite header, from which the cooled coolant returns to the engine. The headers and the heat conduction tubes are disposed in the ambient water, and heat transferred from the coolant, travels through the walls of the heat conduction tubes and the headers, and into the ambient water. The rectangular tubes connecting the two headers are spaced fairly close to each other, to create a large heat flow surface area, while maintaining a relatively compact size and shape. Frequently, these keel coolers are disposed in recesses on the bottom of the hull of a vessel, and sometimes are mounted on the side of the vessel, but in all cases below the waterline. There are of course some rare situations when the keel cooler can be used when not submerged, such as when the vessel is being dry docked.

The foregoing keel cooler is referred to as a one-piece keel cooler, since it is an integral unit with its major components welded or brazed in place. The one-piece keel cooler is generally installed and removed in its entirety.

There are various varieties of one-piece keel coolers. Sometimes the keel cooler is a multiple-pass keel cooler where the headers and heat conduction tubes are arranged to allow at least one 180° change in the direction of flow, and the inlet and outlet ports may be located in the same header.

Even though the foregoing heat exchangers with the rectangular heat conduction tubes have enjoyed widespread use since their introduction over fifty years ago, they have shortcomings which are corrected by the present invention.

The ability of a heat exchanger to efficiently transfer heat from a coolant flowing through heat conduction tubes depends, in part, on the volume of coolant which flows through the tubes and its distribution across the parallel set(s) of tubes, and on whether the coolant flow is turbulent or laminar. The volume flow of coolant per tube therefore impacts heat transfer efficiency and pressure drop across the heat exchanger. In the present heat exchanger with rectangular tubes, the ends or extensions of the outermost rectangular tubes form exterior walls of the respective headers. Coolant flowing through the heat exchanger has limited access to the outermost tubes as determined from data obtained by the present inventors. In addition, the dividing tubes of a multi-pass unit have this same limitation. In the previous art, the outermost tubes have a solid outer wall, and a parallel inner wall. In order for coolant to flow into the outermost rectangular tubes, orifices, most often circular in shape, are cut through the inner wall of each of the outer tubes for passing coolant into and out of the outer tubes. The inlet/outlet orifices of the exterior tubes have been disposed centrally in a vertical direction and endwardly of the respective headers of the keel coolers. However, an analysis of the flow of coolant through the foregoing keel cooler shows that there is a larger amount of coolant per tube flowing through the more central tubes, and much less coolant per tube through the outermost tubes. A graph of the flow through the tubes has a general bell-shaped configuration, with the amount of flow decreasing from the central portion of the tube array. The result is that heat transfer is lower for the outermost tubes, and the overall heat transfer for the keel cooler is also relatively lower, and the pressure drop across the keel cooler is higher than desired. This is so even though the outer tubes should have the greatest ability to transfer heat due to the absence of other tubes on one side.

The flow of coolant through the respective orifices into the outermost rectangular tubes was found to be inefficient, causing insufficient heat transfer in the outermost tubes. It was found that this occurred because the orifices were located higher and further towards the ends of the respective headers than is required for optimal flow. It has been found that by moving the orifice closer to the natural flow path of the coolant flowing through the headers, i.e. its optimal path of flow, coupled with the modification to the design of the header as discussed below, further increased the flow to the outer tubes and made the flow through all of the tubes more uniform, thus reducing the pressure drop across the cooler while increasing the heat transfer.

As discussed below, the beveled wall inside the header contributes to the increase of the overall heat transfer efficiency of the keel cooler according to the invention, since the beveled wall inside the header facilitates coolant flow towards the flow tubes causing a substantial reduction of coolant turbulence in the headers and an associated reduction in pressure drop.

One of the important aspects of keel coolers for vessels is the requirement that they take up as small an area on the vessel as possible, while fulfilling or exceeding their heat exchange requirement with minimized pressure drops in coolant flow. The area on the vessel hull which is used to accommodate a keel cooler is referred to in the art as the footprint. In general, keel coolers with the smallest footprint and least internal pressure drops are most desirable. One of the reasons that the keel cooler described above with the rectangular heat conduction tubes has become so popular, is because of the small footprint it requires when compared to other keel coolers. However, keel coolers according to the design of rectangular tubed keel coolers conventionally used has been found by the present inventors to be larger than necessary both in terms of size and the internal pressure drop. By the incorporation of the various aspects of the present invention described above (and in further detail below), keel coolers having smaller footprints and lower internal pressure drops are possible. These are major advantages of the present invention.

Some of the shortcomings of heat exchangers with rectangular heat conduction tubes conventionally used relate to the imbalance in the coolant flow among the parallel tubes, in particular in keel coolers which lead to both excessive pressure drops and inferior heat transfer which can be improved according to the present invention. The unequal distribution of coolant flow through the heat conduction tubes in present rectangular tube systems has led to inferior heat transfer in the systems. In order to attend to this inferior heat transfer, the designers of most of the present keel coolers on the market have been compelled to enlarge or oversize the keel cooler which also may increase the footprint, through additional tube surface area, to overcome the poor coolant distribution and inferior heat transfer in the system. This has resulted in the conventional one-piece keel coolers which are unnecessarily oversized, and therefore more costly, when compared with the invention described below. In some instances, the invention described below would result in fewer keel coolers in cooling circuits which require multiple keel coolers.

The unequal distribution of coolant flow through the heat conduction tubes in conventional rectangular tube systems also results in higher internal pressure drops in the systems. This higher pressure drop is another reason that the prior art requires oversized heat exchangers. Oversizing can compensate for poor heat transfer efficiency and excessive pressure drops, but this requires added costs and a larger footprint.

When multiple-pass (usually two-pass) keel coolers are specified for the state of the art of conventional one-piece keel coolers, an even greater differential size is required when compared with the present invention, as described below.

There has recently been developed a new type of one-piece heat exchanger which provides various improvements over conventional one-piece heat exchangers. These developments relate to heat exchangers, and in particular to keel coolers, which have beveled end walls on the headers and larger outer tube orifices which have been relocated to improve the flow of coolant to and from the outermost flow tubes. This is disclosed in commonly assigned U.S. patent application Ser. No. 09/427,166 which is incorporated herein by reference. The present invention is a variation on this improvement.

SUMMARY OF THE INVENTION

It is an object of the present invention to provide a heat exchanger for fluid cooled heat sources which is smaller than corresponding heat exchangers having the same heat exchange capability.

Another object of the present invention is to provide an improved heat exchanger for industrial applications which is more efficient than heat exchangers conventionally known and used.

It is yet another object of the present invention to provide an improved one-piece heat exchanger for vessels which is more efficient in heat transfer than conventional one-piece heat exchangers.

It is an additional object to produce a one-piece heat exchanger and headers thereof which generally equalizes the flow of coolant through each of the tubes of the keel cooler.

A further object is to provide an improved one-piece heat exchanger which reduces the pressure drop of coolant flowing therethrough.

A further object of the present invention is to provide an improved one-piece heat exchanger having heat conduction tubes which are rectangular in cross-section having reduced size from the current heat exchangers due to improved coolant flow distribution inside the heat exchanger.

Another object is to provide an improved one-piece heat exchanger having a reduced size from conventional one-piece heat exchangers of comparable heat transfer capability, by reducing the length of the heat transfer tubes, the number of tubes and/or the size of the tubes.

It is another object to provide a keel cooler and header thereof which projects into the water from the hull by a lesser amount than the corresponding one-piece keel coolers and headers thereof, resulting in a lower drag on the vessel.

Another object of the present invention is to provide an improved one-piece keel cooler which is easier to install on vessels than corresponding conventional keel coolers presently on the market.

It is still another object of the invention to provide a one-piece heat exchanger having a reduced pressure drop and a more uniform distribution of coolant flowing therethrough than conventional heat exchangers presently on the market, for increasing the amount of coolant flowing through the heat exchanger to improve its capacity to transfer heat.

Another object of the present invention is to provide a one-piece heat exchanger and headers thereof having rectangular heat conduction tubes having a lower pressure drop in coolant flowing through the heat exchanger than corresponding conventional one-piece heat exchangers.

Another object of the present invention is the provision of a one-piece heat exchanger for a vessel, for use as a retrofit for previously installed one-piece heat exchangers which will surpass the overall heat transfer performance and provide lower pressure drops than the prior units without requiring additional plumbing, or requiring additional space requirements, to accommodate a greater heat output.

It is another object of the invention to provide an improved header for a one-piece heat exchanger having rectangular coolant flow tubes.

Another object is to provide a header for a one-piece heat exchanger which provides for enhanced heat exchange between the coolant and the ambient cooling medium such as water through the wall of the flow tubes.

Yet a further object is to provide a header for a one-piece heat exchanger which provides for more uniform flow of coolant through all tubes of the keel cooler, to improve the heat transfer of the flow tubes as compared to equivalent, current conventional headers.

Still yet a further object of the present invention is to provide a header for a one-piece heat exchanger which provides more efficient flow of coolant fluid into and out of the two outermost rectangular tubes than that of conventional one-piece heat exchangers as well as dividing the tubes in multi-pass models.

A general object of the present invention is to provide a one-piece heat exchanger and headers thereof which are efficient and effective in manufacture and use.

Other objects will become apparent from the description to follow and from the appended claims.

The invention to which this application is directed is a one-piece heat exchanger, i.e. heat exchangers having two headers which are integral with coolant flow tubes. It is particularly applicable to heat exchangers used on marine vessels as discussed earlier, which in that context are also called keel coolers. However, heat exchangers according to the present invention can also be used for cooling heat generating sources (or heating cool or cold fluid) in other situations such as industrial and scientific equipment, and therefore the term heat exchangers covers the broader description of the product discussed herein. The heat exchanger includes two headers, and one or more coolant flow tubes integral with the headers. In a preferred form of the invention, surfaces are provided in at least one of the headers for directed fluid flow entering the header through a nozzle generally equally to the flow tubes through which the fluid exits from the header. The invention in a preferred form further directs fluid from the flow tubes into the nozzle in a fairly direct path without significant amounts of fluid being directed against other parts of the header or back into the fluid flow tubes.

DETAILED DESCRIPTION OF THE PREFERRED EMBODIMENTS

Figure 1:
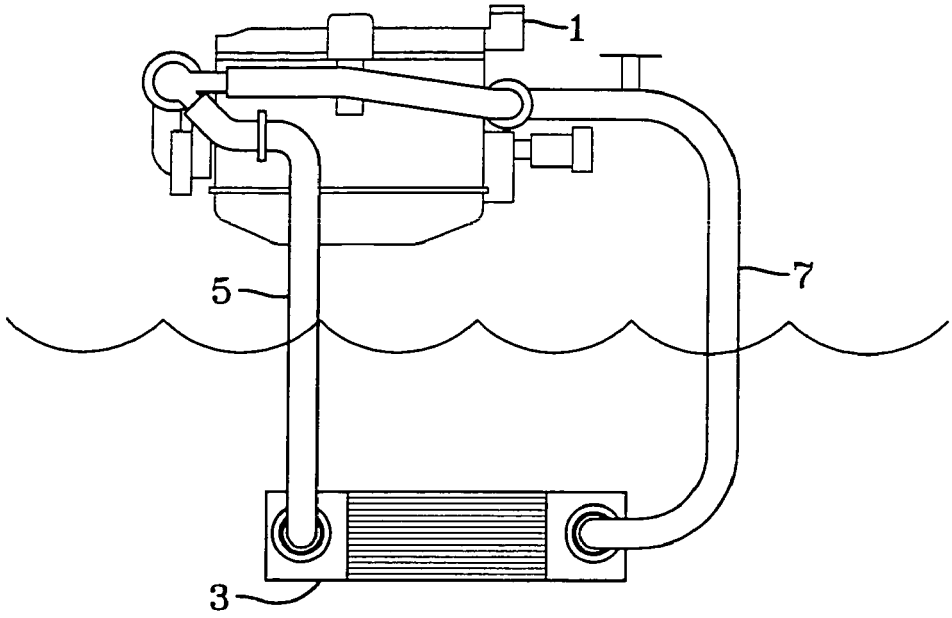
FIG. 1 is a schematic view of a heat exchanger on a vessel in the water.

The fundamental components of a heat exchanger system for a water-going vessel are shown in FIG. 1. The system includes a heat source 1, a heat exchanger 3, a pipe 5 for conveying the hot coolant from heat source 1 to heat exchanger 3, and a pipe 7 for conveying cooled coolant from heat exchanger 3 to heat source 1. Heat source 1 could be an engine, a generator or other heat source for the vessel. Heat exchanger 3 could be a one-piece keel cooler (since only one-piece keel coolers are discussed herein, they are generally only referred to herein as "keel coolers.") Heat exchanger 3 is located in the ambient water, below the waterline (i.e. below the aerated waterline), and heat from the hot coolant is transferred through the thermally conductive walls of heat exchanger 3 and transferred to the cooler ambient water.

Figure 2:
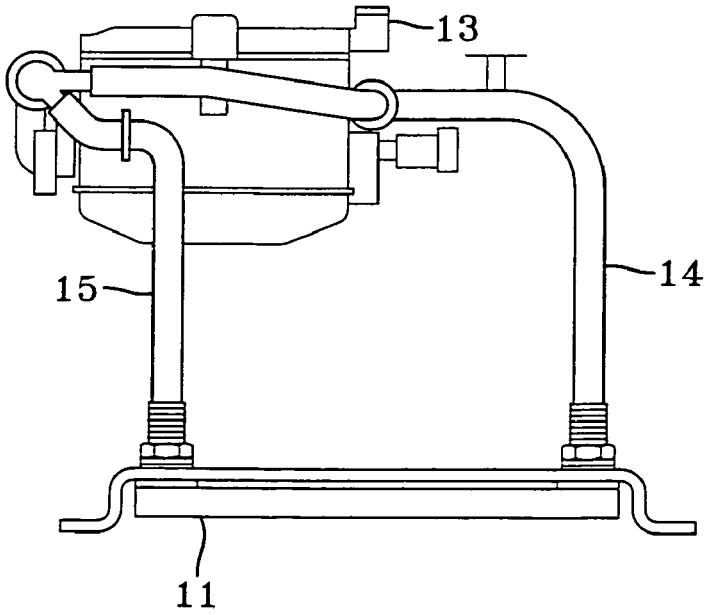
FIG-2 PRIOR ART
FIG. 2 is a side view of an engine for a vessel having a one-piece keel cooler according to the prior art installed on the vessel and connected to the engine.

FIG. 2 shows a heat exchanger 11 mounted on a vessel, for transferring heat from the coolant flowing from an engine or other heat source 13 to the ambient water. Coolant flows from one of lines 14 or 15 from engine 13 to keel cooler 11, and back through the other flow pipe from keel cooler 11 to engine 13. Keel cooler 11 is attached to, but spaced from the hull of vessel.

Figure 3:
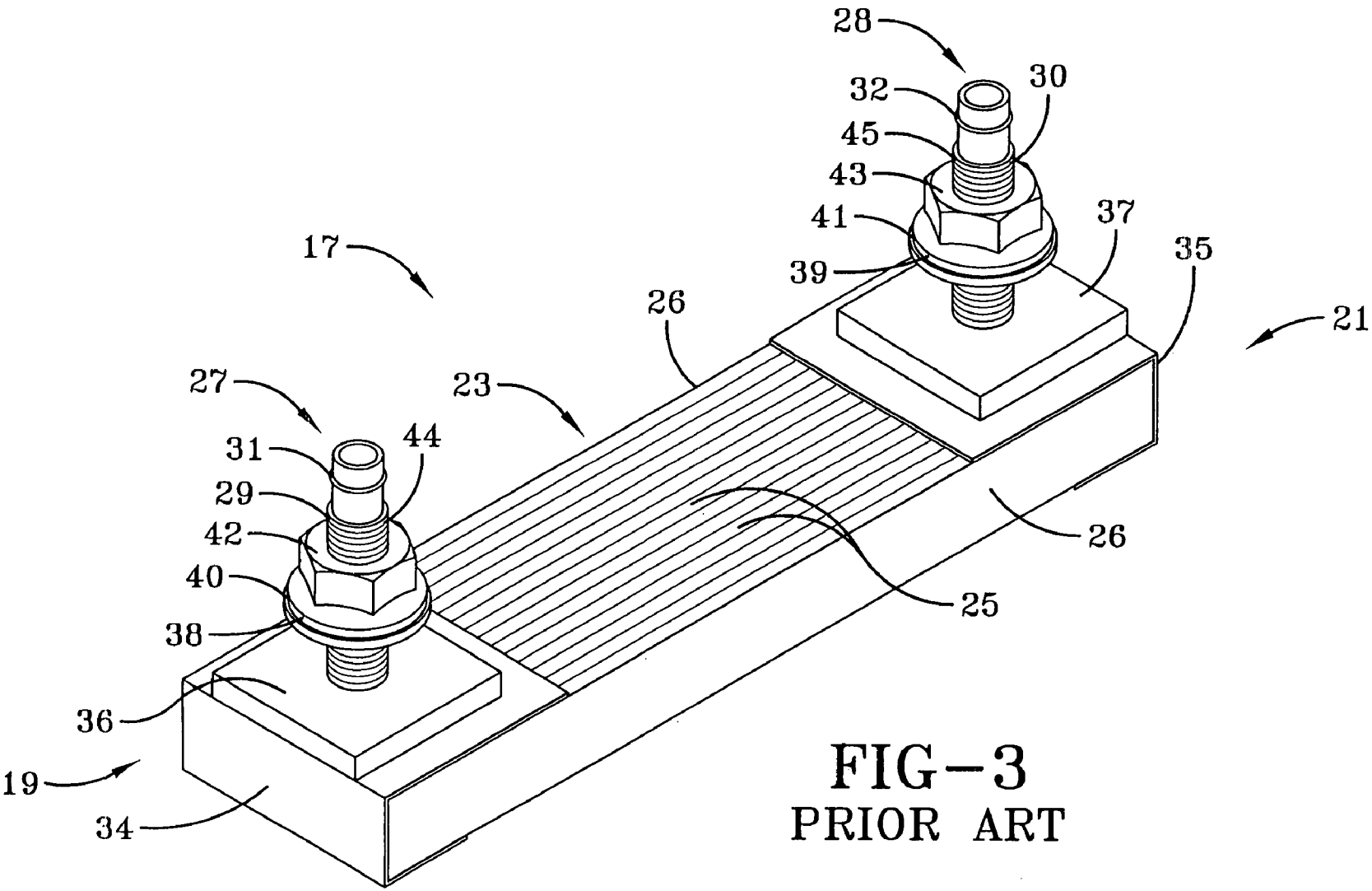
FIG-3 PRIOR ART
FIG. 3 is a pictorial view of a keel cooler according to the prior art.

A keel cooler 17 according to the prior are is shown in FIG. 3. It includes a pair of headers 19, 21 at opposite ends of a set of parallel, rectangular heat conductor tubes 23, having interior tubes 25 and two exterior tubes (discussed below). Of course just one header may be employed if so desired. It is noted that the detailed discussion thereof will be in the context of a single header, however all the features discussed in relation to one header are applied to the second head of the pair of headers. A pair of nozzles 27, 28 conduct coolant into and out of keel cooler 17. Nozzles 27, 28 have cylindrical threaded connectors 29, 30, and nipples 31, 32 at the ends of the nozzles. Headers 19, 21 have a generally prismatic construction, and their ends 34, 35 are perpendicular to the parallel planes in which the upper and lower surfaces of tubes 23 are located. Keel cooler 17 is connected to the hull of a vessel through which nozzles 27 and 28 extend. Large gaskets 36, 37 each have one side against headers 19, 21 respectively, and the other side engages the hull of the vessel. Rubber washers 38, 39 are disposed on the inside of the hull when keel cooler 17 is installed on a vessel, and metal washers 40, 41 sit on rubber washers 38, 39. Nuts 42, 43, which typically are made from metal compatible with the nozzle, screw down on sets of threads 44, 45 on connectors 29, 30 to tighten the gaskets and rubber washers against the hull to hold keel cooler 17 in place and seal the hull penetrations from leaks.

Figure 4:
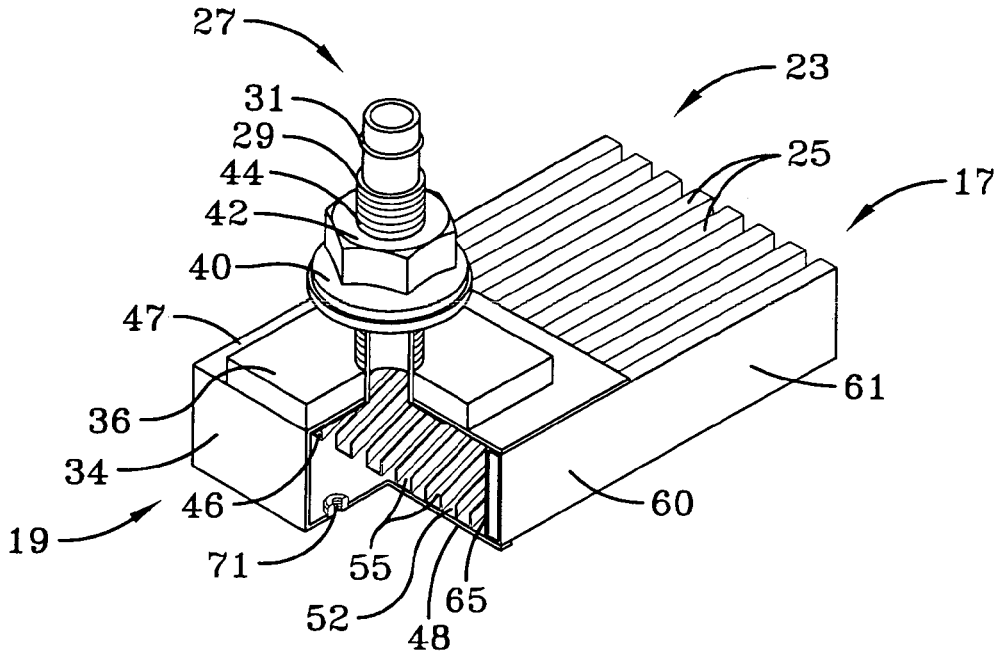
FIG-4 PRIOR ART
FIG. 4 is a partial pictorial view of a partially cut-away header and a portion of the coolant flow tubes of a one-piece keel cooler according to the prior art.

Turning to FIG. 4, a partial, cross section of the current keel cooler according to the prior art and depicted in FIG. 3, is shown. Keel cooler 17 is composed of the set of parallel heat conduction or coolant flow tubes 23 and the header or manifold 19. Nozzle 27 is connected to header 19 as described below. Nozzle 27 has nipple 31, and connector 29 has threads 44 as described above, as well as washer 40 and nut 42. Nipple 31 of nozzle 27 is normally brazed or welded inside of a connector 29 which extends inside the hull. Header 19 has an upper wall or roof 47, outer back wall 34, and a bottom wall or floor 48. Header 19 includes a series of fingers 52 which are inclined with respect to tubes 23, and define spaces to receive ends 55 of interior tubes 25.

Figure 5:
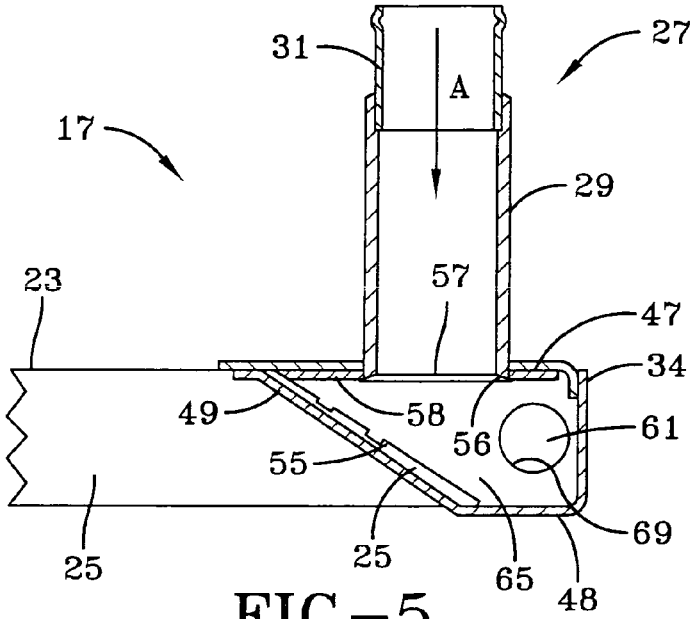
FIG-5 PRIOR ART
FIG. 5 is a cross-sectional view of a portion of a keel cooler according to the prior art, showing a header and part of the coolant flow tubes.

Referring also to FIG. 5, which shows keel cooler 17 and header 19 in cross section, header 19 further includes an inclined surface or wall 49 composed of fingers 52. End portions 55 of interior tubes 25 extend through surface 49. Interior tubes 25 are brazed or welded to fingers 52 to form a continuous surface. A flange 56 surrounds an inside orifice 57 through which nozzle 27 extends and is provided for helping support nozzle 27 in a perpendicular position on the header 19. Flange 56 engages a reinforcement plate 58 on the underside of wall 47.

In the discussion above and to follow, the terms "upper", "inner", "downward", "end" etc. refer to the heat exchanger, keel cooler or header as viewed in a horizontal position as shown in FIG. 5. This is done realizing that these units, such as when used on water-going vessels, can be mounted on the side of the vessel, or inclined on the fore or aft end of the hull, or various other positions.

Each exterior sidewall of header 19 is comprised of an exterior or outer rectangular tube, one of which is indicated by numeral 60 in FIG. 4. The outer tubes extend into header 19. FIGS. 4 and 5 show both sides of outside tube wall 61. Both sides of interior wall 65 are shown in FIGS. 4 and 5. A circular orifice 69 is shown extending through interior wall 65 of the outside rectangular tube of keel cooler 17, and is provided for carrying coolant flowing through the outside tube into or out of header 19. In this regard, nozzle 27 can either be an inlet conduit for receiving hot coolant from the engine whose flow is indicated by the arrow A in FIG. 5, but also could be an outlet conduit for receiving cooled coolant from header 19 for circulation back to the heat source. It is important to note that in the conventional prior art, the location of orifice 69 limits the amount of flow which can pass through orifice 69, and orifice 69 should be large enough so as not to impede coolant flow therethrough. More particularly, the orifice has heretofore been mounted too high, is occasionally too small, and too far away from the natural flow path of the coolant, resulting in reduced flow through the outer rectangular tubes, non-uniform coolant flow through tubes 23, and a disadvantageously high pressure drop as the coolant flows through the orifices, and at higher rates through the less restricted inner tubes—even though the outermost tubes have the greatest ability to transfer heat.

FIG. 4 also shows that keel cooler header 19 has a drainage orifice 71 for receiving a correspondingly threaded and removable plug. The contents of keel cooler 17 can be removed through orifice 71.

Orifice 57 is separated by a fairly large distance from the location of orifice 69, resulting in a reduced amount of flow through each orifice 69, the reduction in flow being largely due to the absence of the orifice in the natural flow path of the coolant. Although this problem has existed for five decades, it was only when the inventors of the present invention were able to analyze the full flow characteristics that they verified the importance of properly locating and sizing the orifice. In addition, the configuration of the header in both single-pass and multiple-pass systems affects the flow through the header as discussed below.

Still referring to the prior art as shown in FIGS. 3–5, gaskets 36, 37 are provided for three essential purposes: (1) they insulate the header to prevent galvanic corrosion, (2) they eliminate infiltration of ambient water into the vessel, and (3) they permit heat transfer in the space between the keel cooler tubes and the vessel by creating a distance of separation between the heat exchanger and the vessel hull, allowing ambient water to flow through that space. Gaskets 36, 37 are generally made from a polymeric substance. In typical situations, gaskets 36, 37 are between one-quarter inch and three quarter inches thick. Keel cooler 17 is installed on a vessel as explained above. The plumbing from the vessel is attached by means of hoses to nipple 31 and connector 29 and to nipple 32 and connector 30. A cofferdam or sea chest (part of the vessel) at each end (not shown) contains both the portion of the nozzle 27 and nut 42 directly inside the hull. Sea chests are provided to prevent the flow of ambient water into the vessel should the keel cooler be severely damaged or torn away, where ambient water would otherwise flow with little restriction into the vessel at the penetration location.

Figure 6:
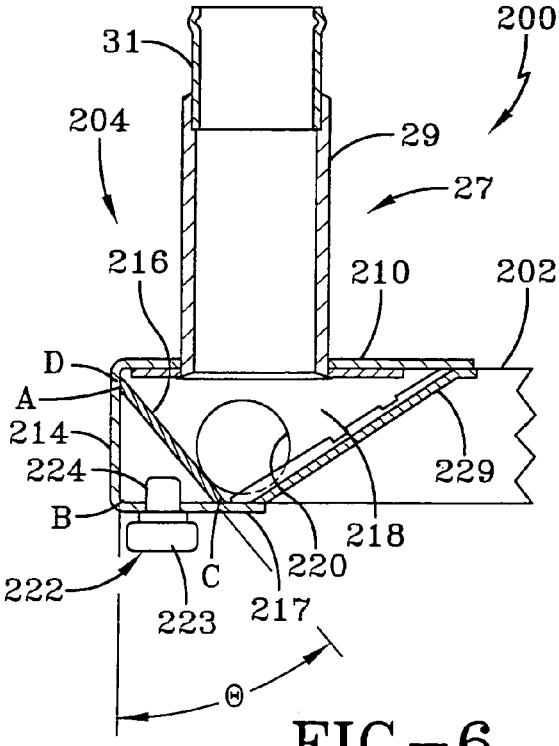
FIG. 6 is a side, cross-sectional, partial view of a portion of one-piece keel cooler according to one embodiment of the invention, showing a header and part of the coolant flow tubes.
Figure 6A:
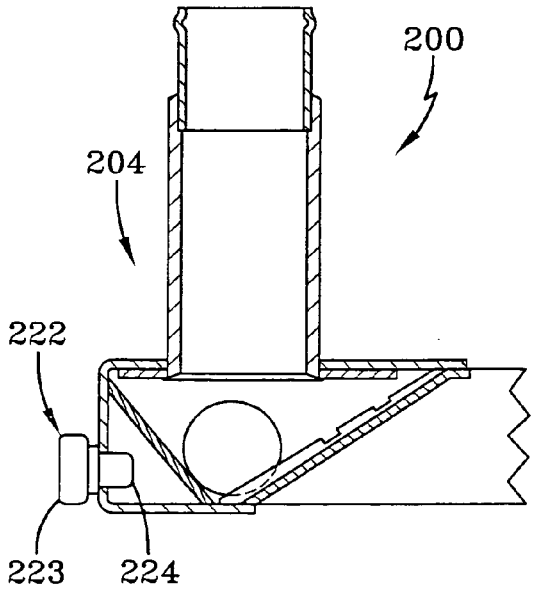
FIG. 6*a* is a side, cross-sectional, partial view of a variation of the embodiment of the apparatus shown in FIG. 6.

Referring next to FIGS. 6–11, the invention in one of the preferred embodiments is shown. One embodiment of the present invention provides a keel cooler having a header with the same external structure and appearance as the prior art, but being advantageously modified internally. The embodiment includes a keel cooler 200 with coolant flow tubes (or heat transfer fluid flow tubes, since in some instances the fluid may be heated instead of cooled) 202 having a generally rectangular cross section. A header 204 is an integral part of keel cooler 200. Tubes 202 include interior or inner coolant flow tubes 206 and outermost or exterior tubes 208. A nozzle 27 having nipple 31 and threaded connector 29, are the same as those described earlier and are attached to the header. Header 204 includes an upper wall or roof 210, an angled wall 216 being integral (or attached by any other appropriate means such as welding) at its upper end with the upper portion of an end wall 214, which in turn is transverse to (and preferably perpendicular to) upper wall 210 and a bottom wall 217. Angled wall 216 may be integral with bottom wall 217 at its lower end, or also attached thereto by appropriate means, such as by welding. In other words, angled wall 216 is the hypotenuse of the triangular cross-section formed by end wall 214, angled wall 216 and bottom wall 217, and shown specifically at points A, B and C in FIG. 6. An interior wall 218 (FIGS. 6–7) of exterior or outermost rectangular flow tube 208 has an orifice 220 (one per header for each end of tubes 208) which is provided as a coolant flow port for coolant flowing between the chamber of header 204 and outer flow tubes 208 (The chamber is defined by upper wall 210, an inclined surface or inner end or inlet end portion 229, angled bottom wall 216, lower wall 217 and end wall 214). Header 204 also has an anode assembly 222 on the underside of header 204 near the end of header 204 (shown in FIG. 6) for reducing corrosion of the keel cooler. It should be appreciated that anode assembly 222 can alternatively be disposed on the outside of end wall 214 (FIG. 6*a*).

Anode assembly 222 includes a steel anode plug(s) 223 which is connected to an anode insert(s) 224 which is part of header 204, an anode mounting screw(s) 242 (FIG. 11), a lock washer(s) 246 (FIG. 11) and anode bar 228, which is normally made of zinc. The anode insert, the anode plug and the anode bar have not changed from the prior art, but were omitted from FIGS. 3 and 4 for the sake of clarity. Anode 222 may still extend downwardly from the underside of bottom wall 217. Alternatively, anode assembly 222 may be placed on the side of end wall 214 that is facing the ambient fluid. In addition, a drain plug 244 (FIG. 11) extends into a drain plug insert, which is also part of header 204. Drain plug 244 also extends downwardly from the underside of bottom wall 217. Drain plug 244 must be located where coolant is present in the header and therefore cannot be directly beneath angled wall 216.

Figure 7:
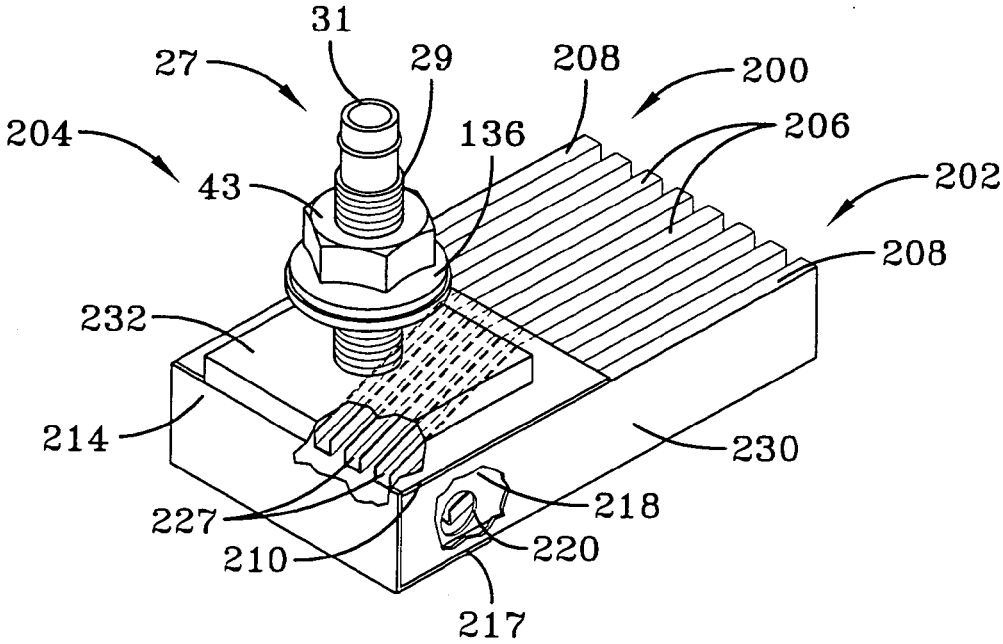
FIG. 7 is a pictorial view of a portion of a one-piece keel cooler according to the first embodiment of the invention, with portions cut away.

Considering specifically cut away FIG. 7, keel cooler 200 includes rectangular tubes 202 with interior tubes 206 and outermost tubes 208, and inner wall 218 (with orifice 220) of the outermost tubes 208. The open ends or inlets or ports for interior tubes 206 are shown by numeral 227. Tubes 206 join header 204 through inclined surface 229 (FIG. 6) on the opposite part of header 204 from angled wall 216. Exterior tubes 208 have outer walls 230, part of which are also the sidewalls of header 204. A gasket 232, similar to and for the same purpose as gasket 36, is disposed on roof 210.

Figure 8:
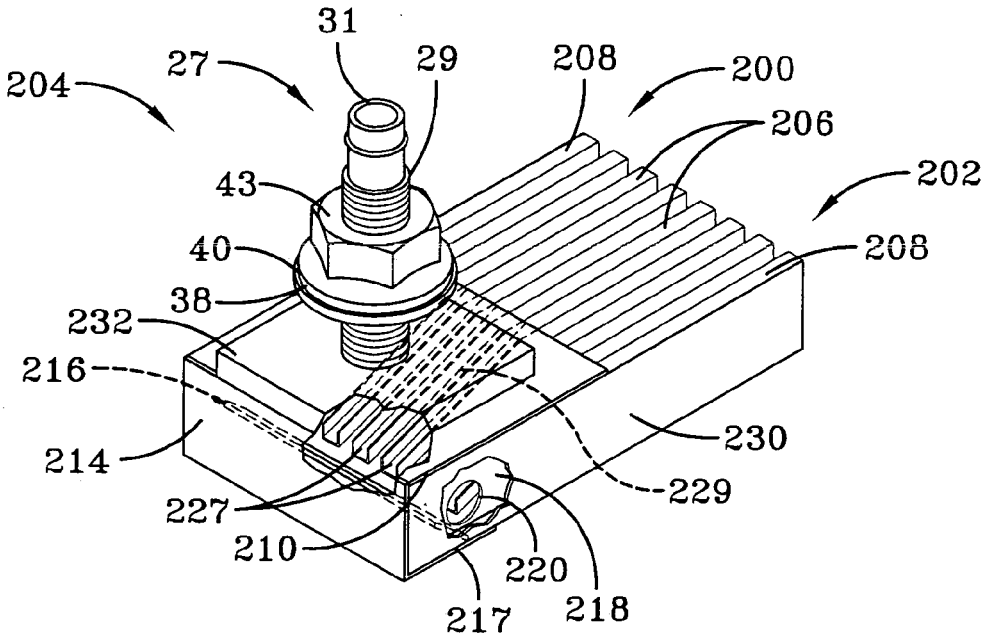
FIG. 8 is a pictorial view of a header and part of the coolant flow tubes of a one-piece keel cooler according to the first embodiment of the invention.
Figure 9:
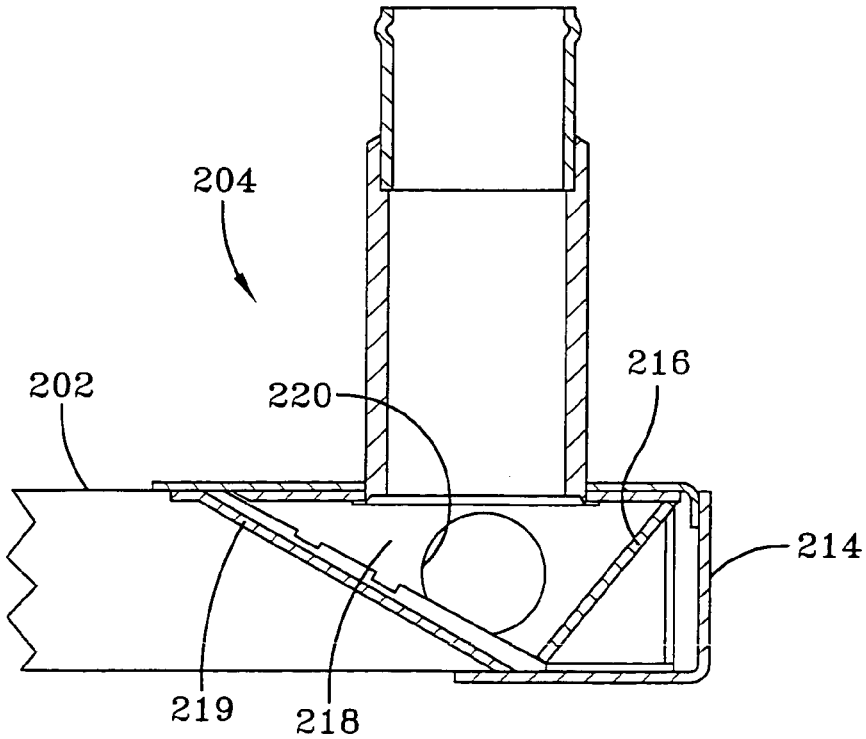
FIG. 9 is a side view of part of the apparatus shown in FIG. 8.
Figure 10:
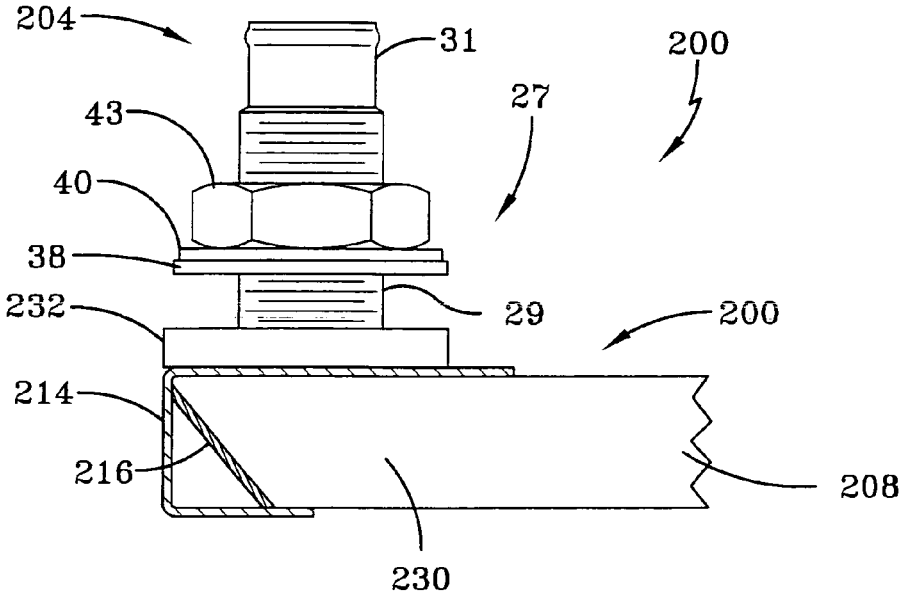
FIG. 10 is a side view of the apparatus shown in FIG. 8.
Figure 11:
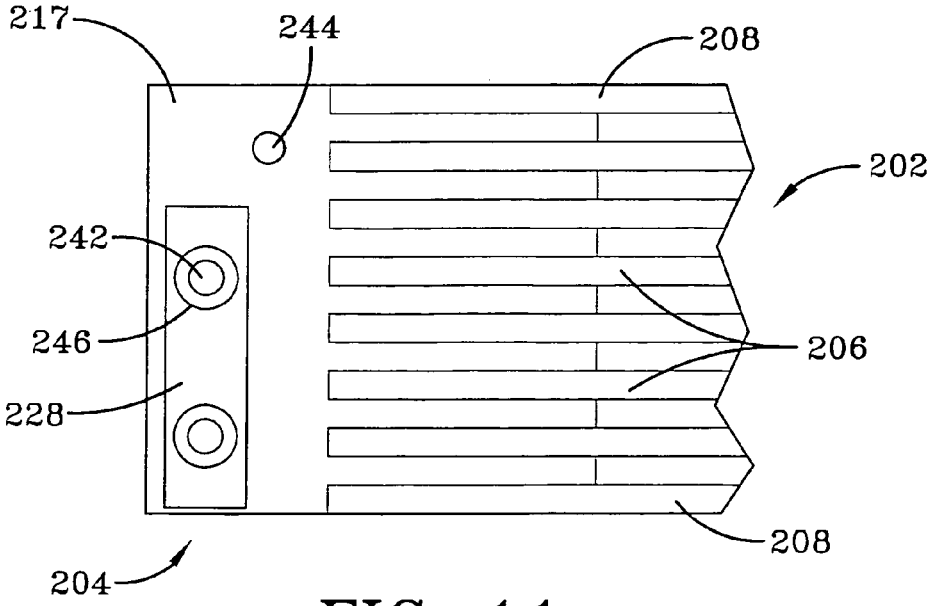
FIG. 11 is a partial bottom view of the apparatus shown in FIG. 8.

An important part of the present invention is the angled wall 216. Angled wall 216 provides a number of important advantages to the keel cooler. First, being angled as shown in FIGS. 6 and 8, angled wall 216 enhances the continuous flow of coolant either from heat conduction tubes 202 into nozzle 27, where nozzle 27 is an outlet nozzle, or from nozzle 27 into tubes 202, where nozzle 27 is an inlet nozzle. When nozzle 27 is an inlet, angled wall 216 in cooperation with the angled surface 229 acts to direct the flow of coolant into orifice 220 and openings 227, i.e. angled wall 216 directs the natural flow of coolant from the nozzle 27 to orifices 220 and tube openings 227. It can be seen that angled wall 216 either facilitates the coolant flow towards inlets 227 and to each of tubes 202 (including orifices 220 in interior wall 218 of exterior tubes 208) or from tubes 202 for discharge of coolant into nozzle 27 where nozzle 27 is an outlet nozzle. The increased coolant flow in the outermost tubes results in improved coolant flow distribution among all the tubes, which provides a lower pressure drop across the entire system and greater heat transfer between the coolant, through tubes 202 and through the walls of header 204, and the ambient water. For example, for a keel cooler having eight rectangular tubes whose external dimensions are 2½ inches in height and ½ inch in width, and the keel cooler is mounted on a vessel with a 2 knot speed, the coolant flow to the outer tubes increased up to 35% over the flow under corresponding heat exchange conditions using a heat exchanger according to a previous design of the same size (i.e. the numbers of tubes and lengths of the tubes) as shown in FIGS. 3–5, which had poor flow distribution. In addition, the heat transferred by the exterior tubes increased by 45% over the corresponding heat transfer under corresponding conditions using the prior art keel cooler shown in FIGS. 3–5. The total heat transfer of the entire system increased by about 17% in a particular instance over the corresponding unit of FIGS. 3–5. As explained below, the improvement over the prior art is expected to be even greater for two-pass (or more) systems. Also, as discussed later, the deficiencies of the prior art for higher coolant flows, are not experienced to the same extent by the keel cooler according to the invention.

The angle of angled wall 216 is an important part of the present invention. As discussed herein, the angle, designated as θ (theta) (FIG. 6), is appropriately measured from the plane perpendicular to the longitudinal direction of coolant flow tubes 202 to angled wall 216. Angle θ is selected to minimize the pressure drop in coolant flow through the header.

Figure 12:
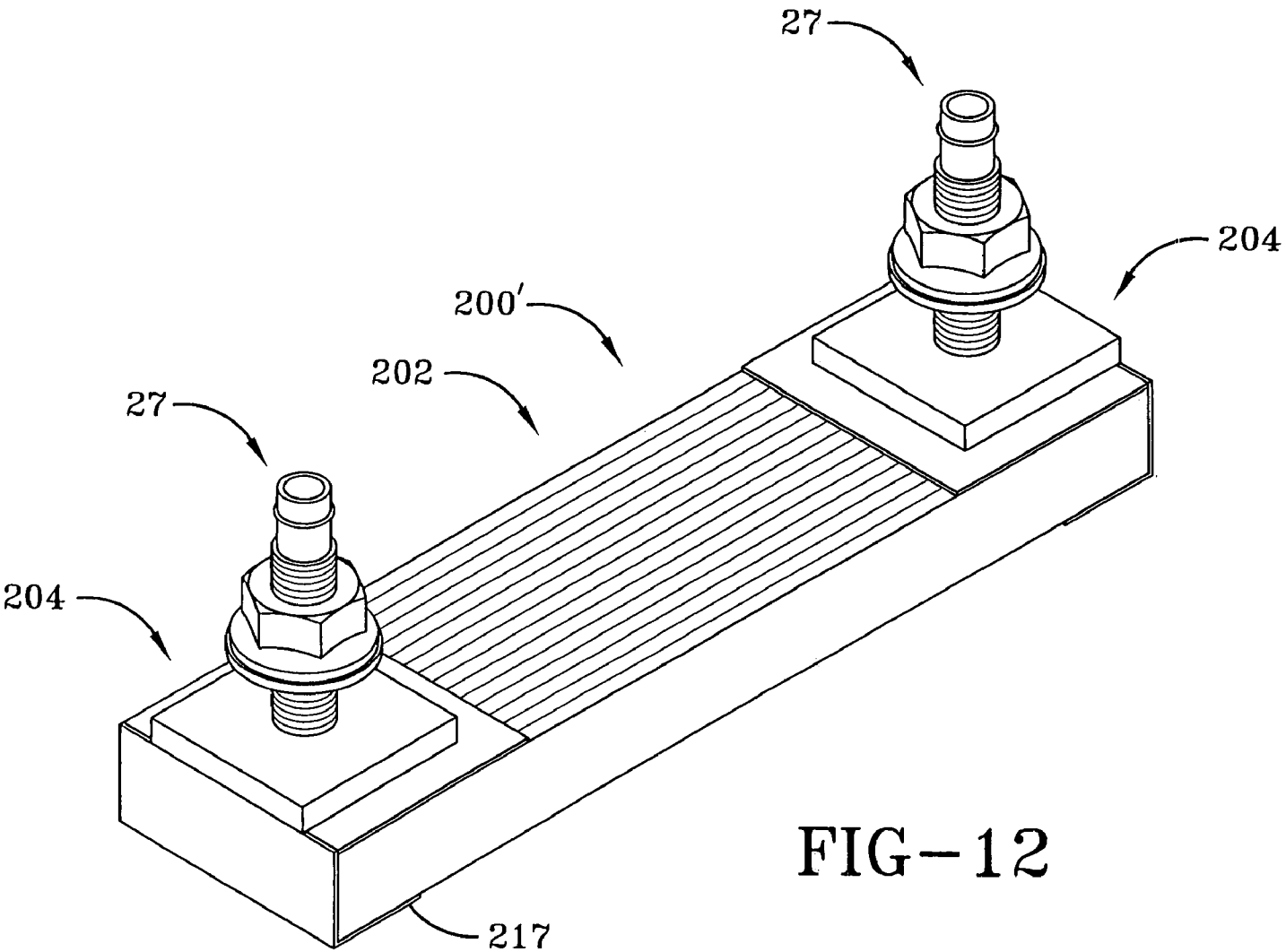
FIG. 12 is a pictorial view of a keel cooler according to the first embodiment of the invention.

Keel coolers according to the invention are used as they have been in the prior art, and incorporate two headers which are connected by an array of parallel coolant flow tubes. A common keel cooler according to the invention is shown in FIG. 12, which illustrates a keel cooler 200' having opposing headers 204 like the one shown in FIG. 7. The headers shown have the identical numbers to those shown in FIG. 7. Heated coolant fluid flows into one nozzle 27 from a heat source in the vessel, then flows through one header 204, the coolant flow tubes 202, the other header 204, the other nozzle 27, and the cooled coolant flows back to the heat source in the vessel. While flowing through headers 204 and coolant flow tubes 202, the coolant transfers heat to the ambient water. All of the advantages of the angled wall 216 apply to keel cooler 200'.

As mentioned above, the size of orifice 220 is an important part of the new keel cooler and the new header. It is desirable to have the orifice be sufficiently large so as not to impede the amount of coolant flow to exterior heat conduction tubes 208 of the keel cooler, and to implement a balanced flow near the juncture of angled wall 216 and the interior of surface 229 and ports 227. It has been found that a distance of about ⅛ of an inch between orifice 220 and walls adjacent its lower edge (the interior of the lower parts of wall 216, wall 217 and surface 229, as shown in FIG. 6) be provided for manufacturing tolerance as it is fabricated, which is advantageously done by drilling or cutting orifice 220 into wall 218. It is important that the coolant flow into exterior tubes 208 be near the bottom of walls 218, rather than closer to their top. The distance between the top of orifice 220 and roof 210 is not as crucial. The proper size and placement of orifice 220 thus reduces the pressure drop of the coolant in the entire system of keel cooler 200, balances the flow among the multiple tubes, and thus increases the heat transfer through the outer tubes and therefore the entire unit.

Figure 13:
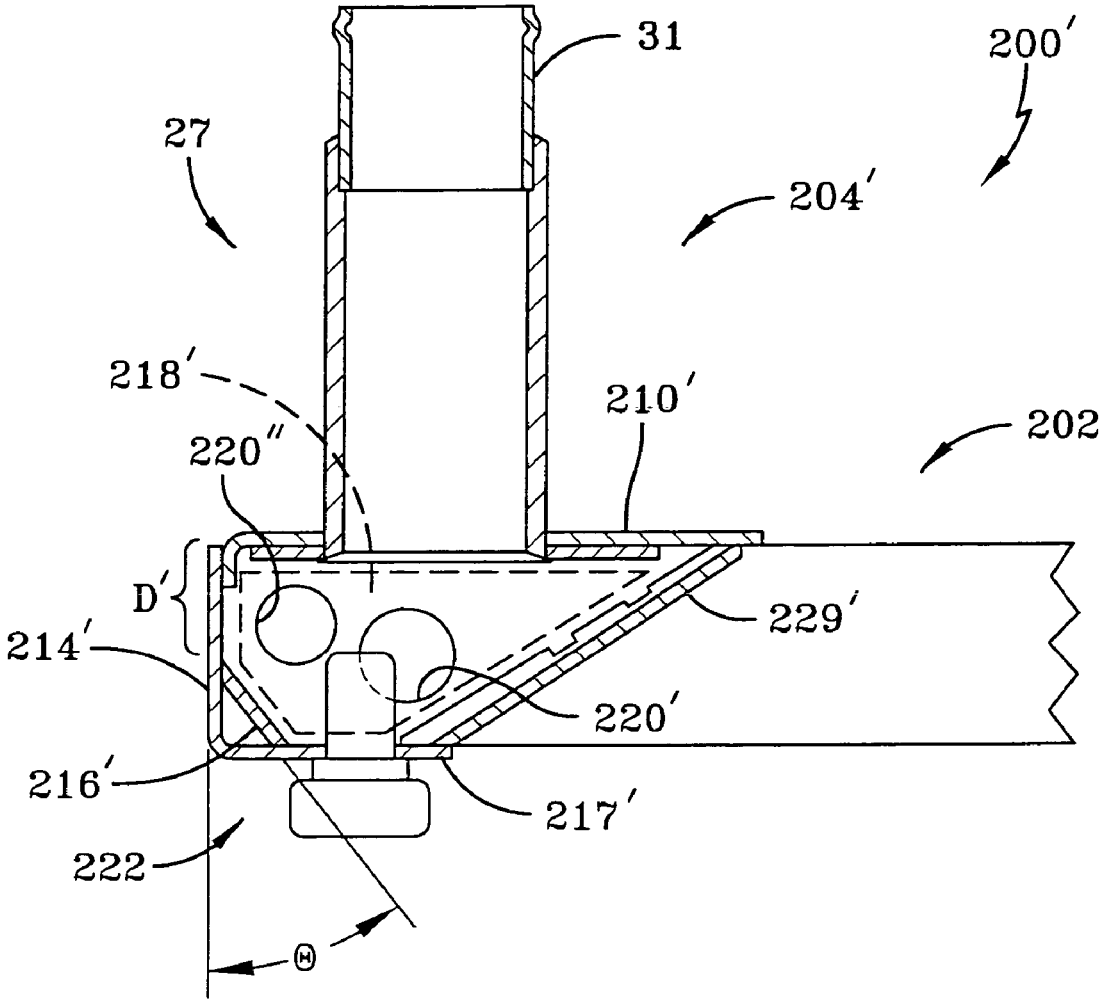
FIG. 13 is a cross-sectional view of a portion of a keel cooler, having several variations of the orifice(s) for the flow of coolant between the header and the outermost coolant flow tube, according to an aspect of the first embodiment of the invention.

As a practical matter, it has been found that a circular orifice having a diameter as large as possible while maintaining the orifice in its wall within the header provides the desired coolant flow into the outermost tubes while enabling the proper amount of flow into the inner tubes as well. More than one orifice can also be provided, as shown in FIG. 13, where all of the members have the same numerical designators shown in FIGS. 6–11, except that some have a prime (') designation since angle θ has been changed to 40°, portion D' of wall 214' is longer than portion D of wall 214 (FIG. 6), angled wall 216' is shorter than wall 216 and the configuration of wall 218' has been modified from wall 218. Orifice 220 has been replaced by two orifices 220' and 220".

The orifice has been shown as one or more circular orifices, since circular orifices are relatively easy to provide. However, non-circular orifices are also within the scope of the invention, and a length of wall 218 (FIG. 8) could be dispensed with (as shown at 218' in FIG. 13). The dispensed part of wall 218 is shown with dotted lines and any other shape or size of wall 218 can be dispensed with so long as dispensed wall 218' is larger than orifice 220', and so long as the dispensed wall 218' encompasses the location orifice 220 would be if orifice 220 were present.

The importance of the size and location of orifice 220 has other advantages as well. So far, only single-pass keel cooler systems have been described. The problems with the size and location of the orifice to the outside tubes may be magnified for multiple-pass systems and for multiple systems combined, as explained below. For example, in two-pass systems, the inlet and outlet nozzles are both disposed in one header, and coolant flows into the header via an inlet nozzle, through a first set of tubes from the first header into the second header (with no nozzles), and then back through a second set of tubes at a lower pressure—and finally out from the header via an outlet nozzle. More than two passes are also possible.

Figure 14:
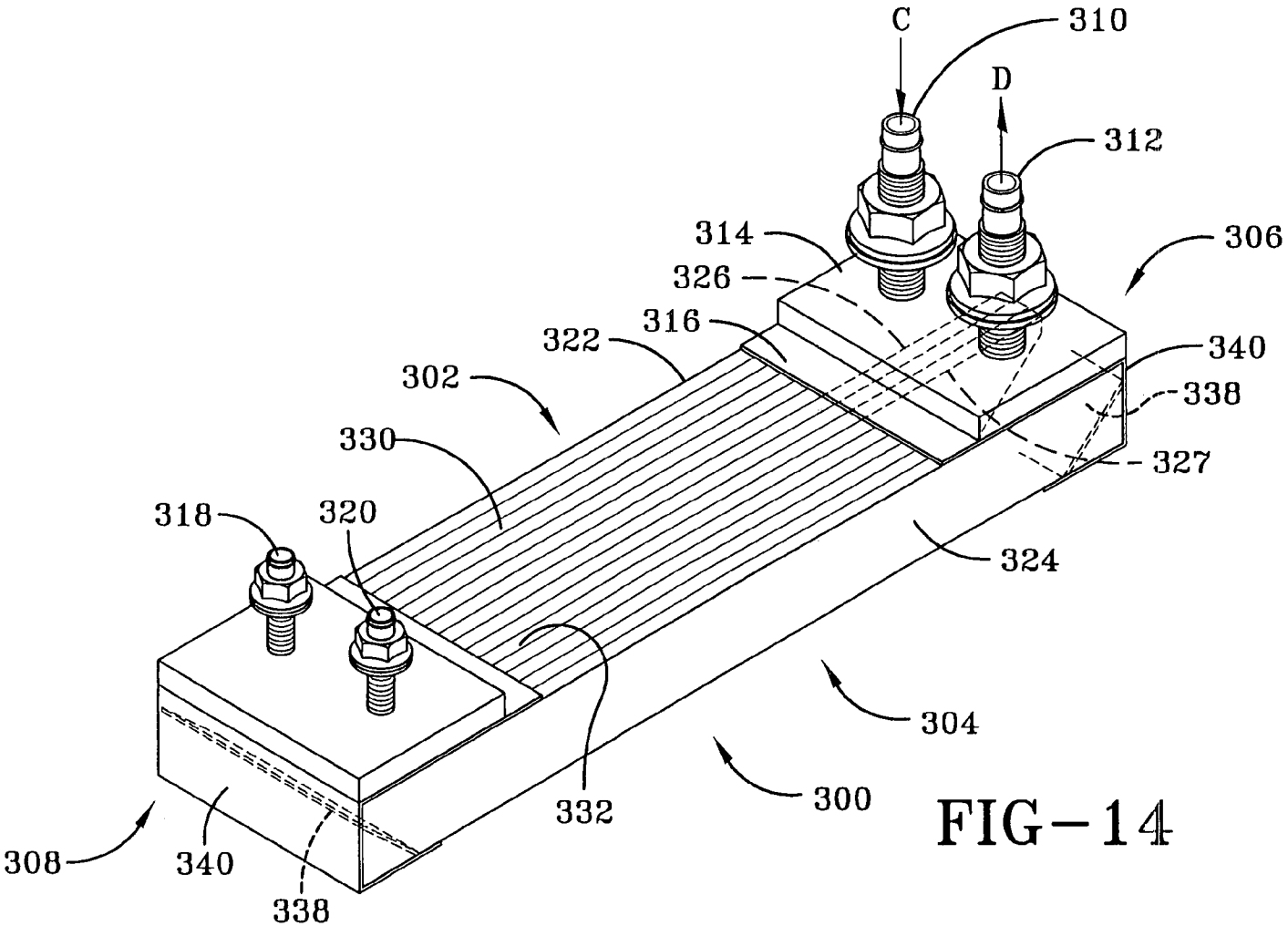
FIG. 14 is a pictorial view of a two-pass keel cooler system according to the first embodiment of the invention.
Figure 15:
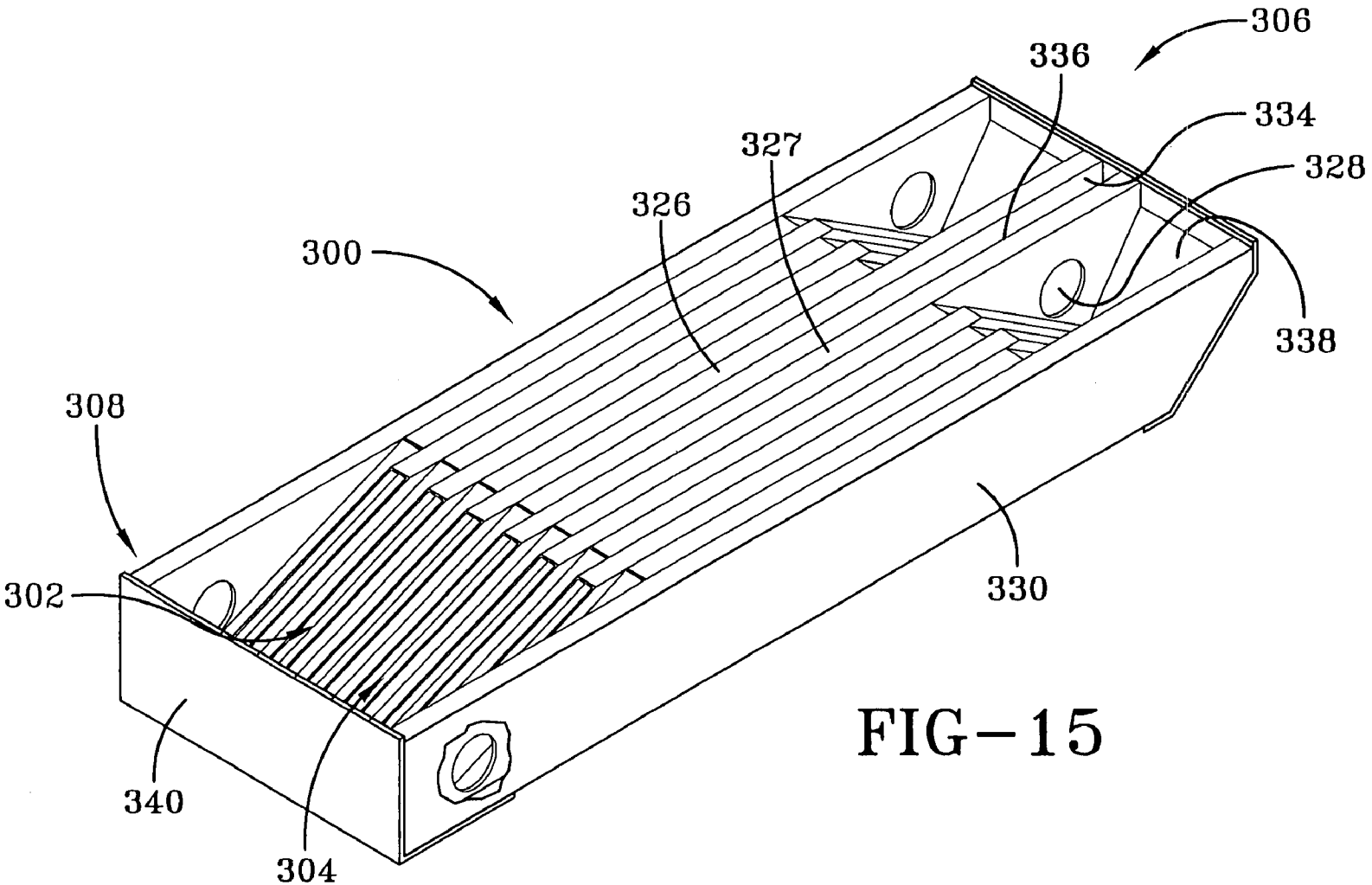
FIG. 15 is a cut away perspective view of a portion of the header shown in FIG. 15.

Referring to FIGS. 14 and 15, a two-pass keel cooler 300 according to the invention is shown. Keel cooler 300 has two sets of coolant flow tubes 302, 304, a header 306 and an opposite header 308. Header 306 has an inlet nozzle 310 and an outlet nozzle 312, which extend through a gasket 314. Gasket(s) 314 is located on roof 316 of header 306. The other header 308 has no nozzles, but rather has one or two stud bolt assemblies 318, 320 for connecting the portion of the keel cooler which includes header 308 to the hull of the vessel. The hot coolant from the engine or generator of the vessel enters nozzle 310 as shown by arrow C, and the cooled coolant returns to the engine from header 306 through outlet nozzle 312 shown by the arrow D. Outer tubes 322, 324 are like outer tubes 208 in FIGS. 7, 8 and 10 in that orifices corresponding to orifice 220 direct coolant into tube 322 and from tube 324. In addition, a tube 326 serves as a separator tube for delivering inlet coolant from header 306 to header 308, and it has an orifice (not shown) for receiving coolant for separator tube 326 under high pressure from a part of header 306 as discussed below. Similarly, a tube 327 which is the return separator tube for carrying coolant from header 308, also has an orifice 328 in header 306.

For space limitations or assembly considerations, sometimes (as noted above) it is necessary to remove the inner wall or a section of the inner tube instead of one or the other of the orifices. Other times, a separator plate is used and the standard angle interior tubes are used instead of separator tubes.

Keel cooler 300 has one set of coolant flow tubes 302 for carrying hot coolant from header 306 to header 308, where the direction of coolant flow is turned 180° by header 308, and the coolant enters a second set of tubes 304 for returning the partially cooled coolant back to header 306. Thus, coolant under high pressure flows through tubes 302 from header 306 to header 308, and the coolant then returns through tubes 304, and subsequently through nozzle 312 to the engine or other heat source of the vessel. Walls 334 and 336 (shown in FIG. 15) of tubes 326 and 327 in header 306 are solid, and act as separators to prevent the mixing of the hot coolant going into coolant flow tubes 302, and the cooled coolant flowing from tubes 304. There is a fairly uniform rate of flow through the tubes in both directions. Such efficient systems have been unable to be produced under the prior art, since the pressure drop across all six (or as many as would be realistically considered) orifices made the prior keel coolers too inefficient due to poor coolant distribution to be operated without a substantial additional safety factor. That is, in order to have two-pass systems, prior one-piece keel cooler systems having two-pass arrangements are up to 20% larger than those required pursuant to the present invention to provide sufficient heat exchange surfaces to remove the required amount of heat from the coolant while attempting to maintain acceptable pressure drops.

An angled wall 338 is also provided in this embodiment for purposes of directing the flow of ambient fluid from nozzle 310 or 312 towards flow tubes 302. Angled wall 338 is encased within headers 306 and 308 in the same manner as described in the previous embodiment. Header 306 is a rectangular header having an end wall 340 adjoined at a substantially right angle to the outer wall of exterior tubes 322 and 324.

The keel cooler system shown in FIGS. 14 and 15 has 8 flow tubes. However, the two-pass system would be appropriate for any even number of tubes, especially for those above two tubes. There are presently keel coolers having as many as 24 tubes, but it is possible according to the present invention for the number of tubes to be increased even further. These can also be keel coolers with more than two passes. If the number of passes is even, both nozzles are located in the same header. If the number of passes is an odd number, there is one nozzle located in each header.

Figure 16:
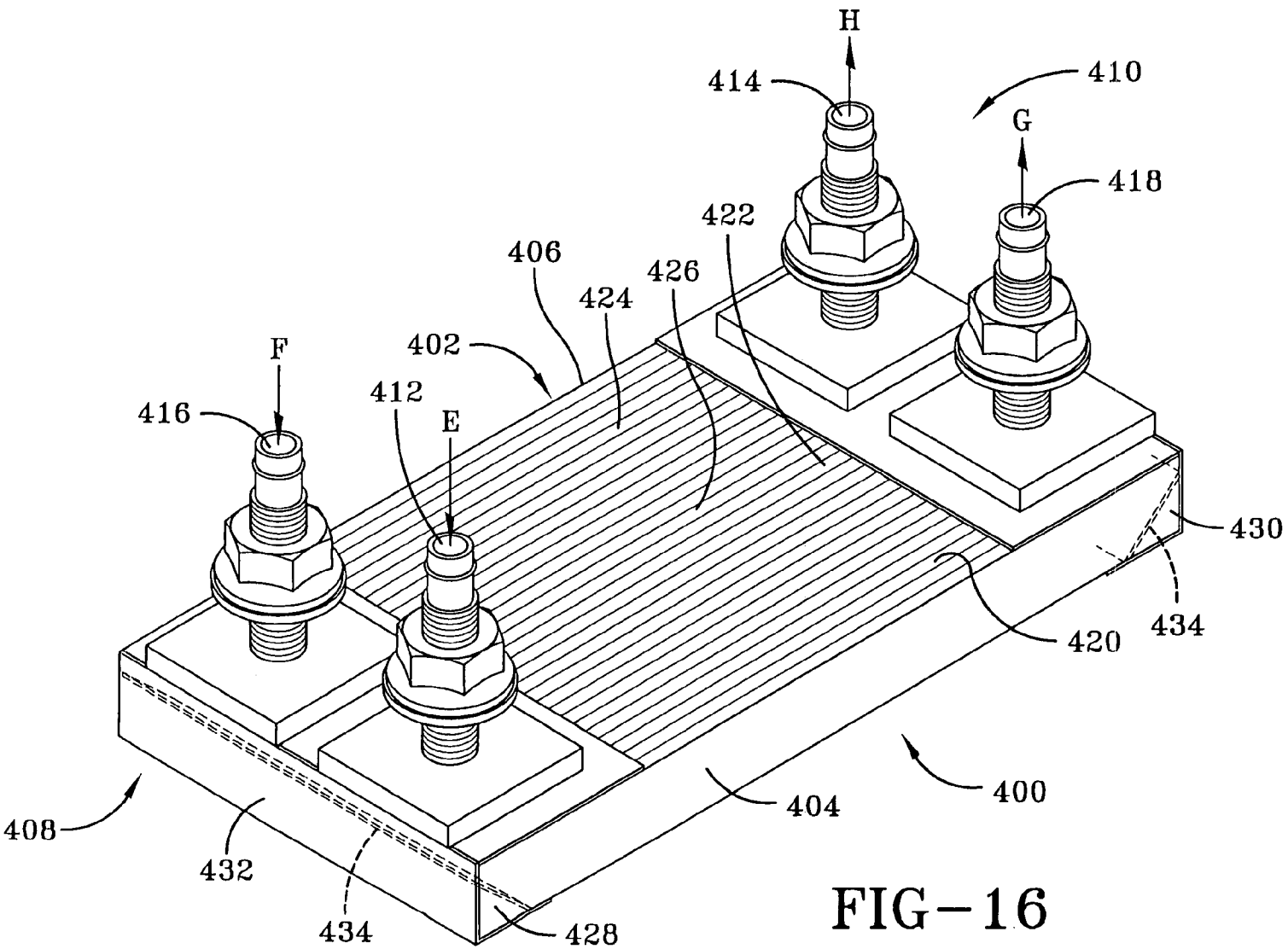
FIG. 16 is a pictorial view of a multiple systems combined, having two single-pass portions, according to the first embodiment of the invention.

Another aspect of the present invention is shown in FIG. 16, which shows a multiple systems combined keel cooler which has heretofore not been practically possible with one-piece keel coolers. Multiple systems combined can be used for cooling two or more heat sources, such as two relatively small engines or an after cooler and a gear box in a single vessel. Although the embodiment shown in FIG. 16 shows two keel cooler systems, there could be additional ones as well, depending on the situation. As explained below, the present invention allows multiple systems to be far more efficient than they could have been in the past. Thus, FIG. 16 shows a multiple systems keel cooler 400. Keel cooler 400 has a set of heat conducting or coolant flow tubes 402 having outer tubes 404 and 406, which have orifices at their respective inner walls which are similar in size and position to those shown in the previously described embodiments of the invention. For two single-pass, multiple systems combined, keel cooler 400 has identical headers 408 and 410, having inlet nozzles 412, 416 respectively, and outlet nozzles 414, 418 respectively. Both nozzles in respective headers 408 and 410 could be reversed with respect to the direction of flow in them, or one could be an inlet and the other could be an outlet nozzle for the respective headers. The direction of the coolant flow through the nozzles is shown respectively by arrows E, F, G and H. A set of tubes 420 for conducting coolant between nozzles 412 and 418 commence with outer tube 404 and terminate with separator tube 422, and a set of tubes 424 extending between nozzles 414 and 416, commencing with outer tube 406 and terminating with separator tube 426. The walls of tubes 422 and 426 which are adjacent to each other are solid, and extend between the end walls of headers 408 and 410. These walls thus form system separators, which prevent the flow of coolant across these walls, so that the tubes 420 form, in effect, one keel cooler, and tubes 424 form, in effect, a second keel cooler (along with their respective headers). Keel cooler 400 has angled closed end portions 428, 430 as discussed earlier. This type of keel cooler can be more economical than having two separate keel coolers, since there is a savings by only requiring two headers, rather than four. Multiple keel coolers can be combined in various combinations. There can be two or more one-pass systems as shown in FIG. 16.

An angled wall 434 is also provided in this embodiment for purposes of directing the flow of ambient fluid from nozzle 412 or 416 towards flow tubes 402. Angled wall 434 is encased both within header 408 and header 410 in the same manner as described in the previous embodiments. Header 408 is a rectangular header having an end wall 432 adjoined at a substantially right angle to the outer wall of exterior tubes 404 and 406. Header 410 is similarly constructed.

Figure 17:
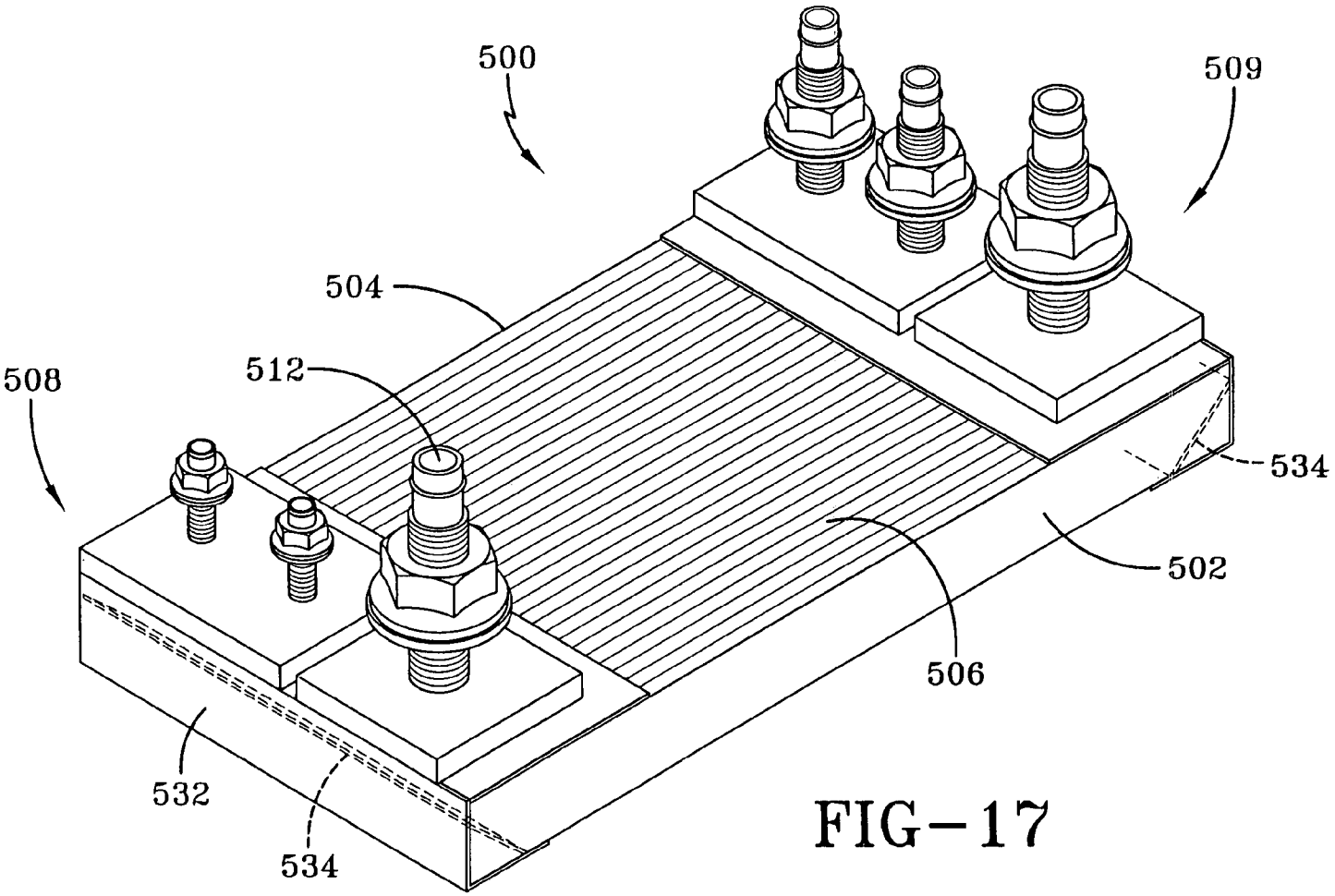
FIG. 17 is a pictorial view of a keel cooler according to the first embodiment of the invention, having a single-pass portion and a double-pass portion.

There can be one or more single-pass systems and one or more double-pass systems in combination as shown in FIG. 17. In FIG. 17, a keel cooler 500 is depicted having a single-pass keel cooler portion 502, and a double-pass keel cooler portion 504. Keel cooler portion 502 functions as that described with reference to FIGS. 6–11, and keel cooler portion 504 functions as that described with reference to FIGS. 15 and 16. FIG. 17 shows a double-pass system for one heat exchanger, and additional double-pass systems could be added as well. As stated supra, the system includes a header 508 housing an angled wall 534 for purposes of directing the flow of ambient fluid from nozzle 512 towards a set of flow tubes 506. Angled wall 534 is encased within header 408 in the same manner as described in the previous embodiments. Header 508 is a rectangular header having an end wall 532 adjoined at a substantially right angle to the outer wall of the exterior tubes 502 and 504. The system includes a second header 509 with a like angled wall 534.

Figure 18:
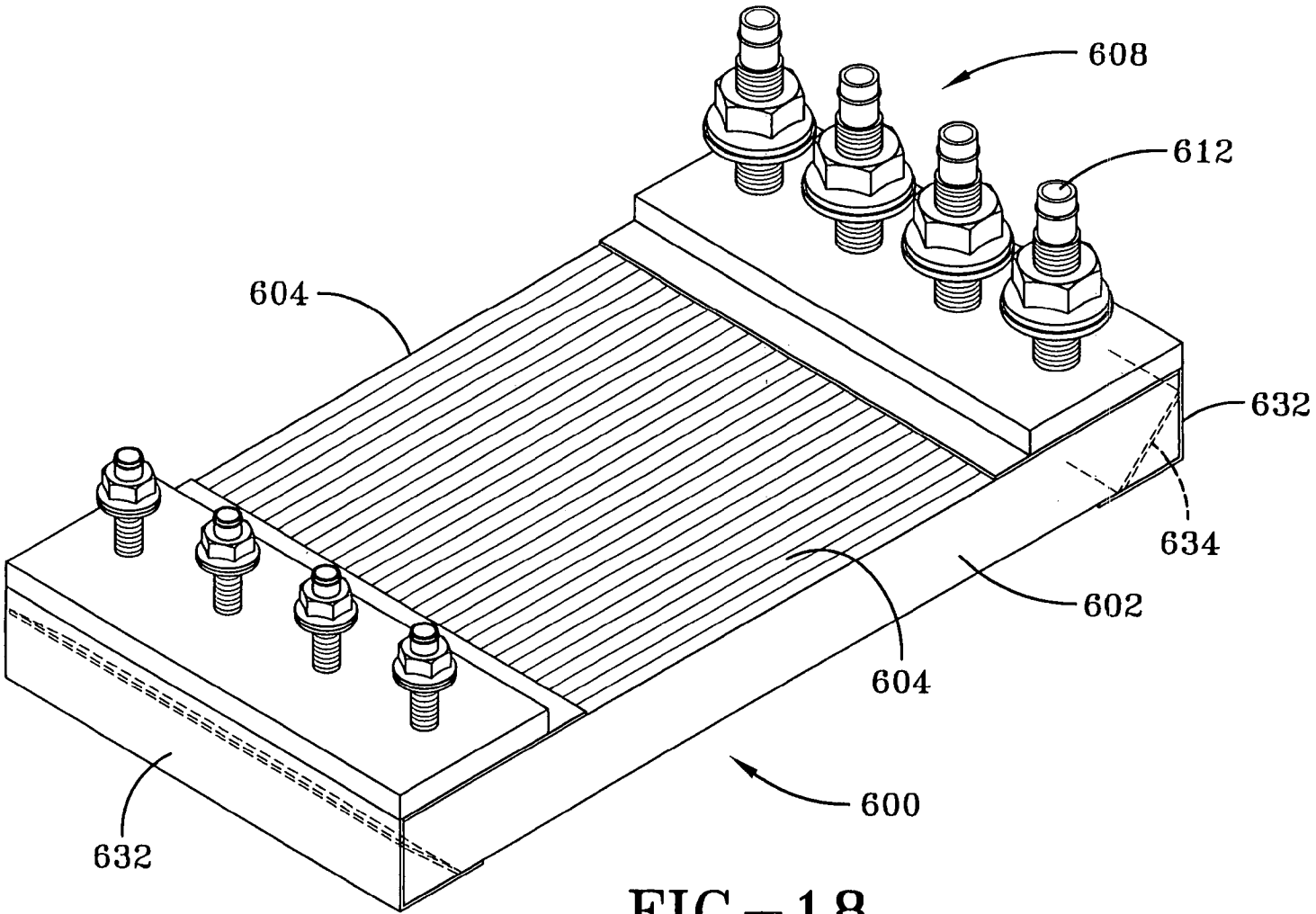
FIG. 18 is pictorial view of two double-pass systems according to the first embodiment of the invention.

FIG. 18, shows a keel cooler 600 having 2 double-pass keel cooler portions 602, 604, which can be identical or have different capacities. They each function as described above with respect to FIGS. 15 and 16. Multiple coolers combined is a powerful feature not found in prior one-piece keel coolers. The modification of the special separator/tube design improves heat transfer and flow distribution while minimizing pressure drop concerns. In addition, keel cooler 600 employs an angled wall 634 in this embodiment for purposes of directing the flow of ambient fluid from a nozzle 612 towards a set of flow tubes 604. Angled wall 634 is encased within a header 608 in the same manner as described in the previous embodiments. Header 608 is a rectangular header having an end wall 632 adjoined at a substantially right angle to the outer wall of exterior tubes 602 and 604.

Figure 19:
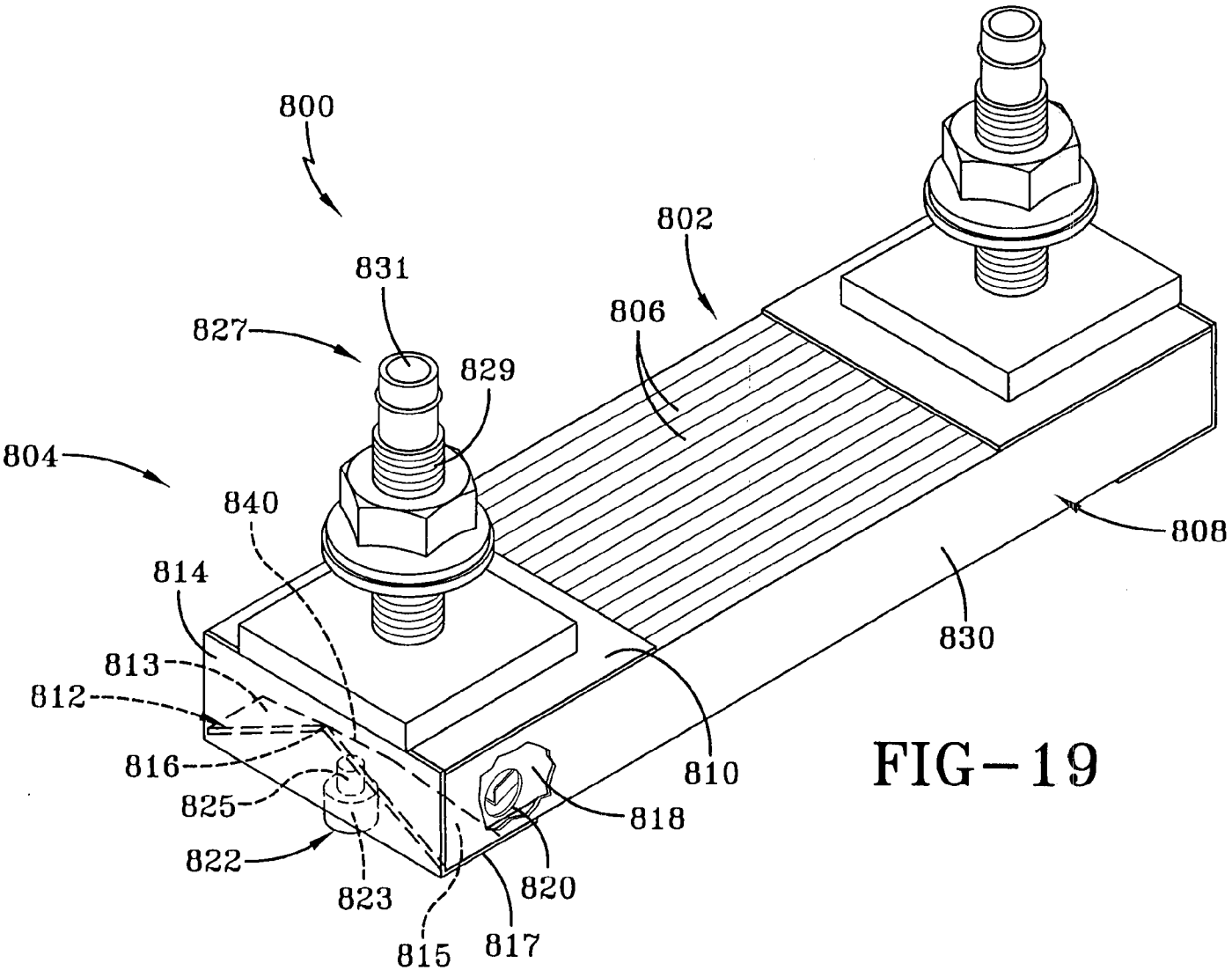
FIG. 19 is a pictorial view of a one-piece keel cooler according to a second embodiment of the present invention.

Turning now to FIG. 19, an additional embodiment of the keel cooler of the present invention is described and shown in a keel cooler 800. Keel cooler 800 comprises a plurality of coolant flow tubes 802 (or heat transfer fluid flow tubes) and at least one header 804. Flow tubes 802 comprise a plurality of interior flow tubes 806 and outermost or exterior flow tubes 808. Each exterior tube 808 is defined by an outer wall 830 and an inner wall 818. A nozzle 827 having a nipple 831 and a threaded connector 829 are the same as those described earlier and are attached to header 804. Header 804 includes an upper wall or roof 810, a flow diverter or baffle 812, a bottom wall 817 and an end wall 814. End wall 814 is attached to outer wall 830 at a substantially right angle so that header 804 is essentially rectangular or square shaped.

Keel cooler 800 also includes an anode assembly 822, which is the same as that described above. Anode assembly 822, as explained above, has not changed from the prior art and is still located in substantially the same location on keel cooler 800 as in the prior art, that is underneath header 804 of keel cooler 800. Also as explained above, keel cooler 800 includes a drain plug 844 (FIG. 20) and anode assembly 822 includes a steel anode plug(s) 823 which is connected to an anode insert 825, the anode insert 825 being a part of keel cooler 800. Anode assembly 822 further includes an anode bar 848 (FIG. 20), which is normally made of zinc or aluminum, and is secured to the underside of header 804 by at least one anode mounting screw(s) 842 (FIG. 20) and a corresponding lock washer(s) 846 (FIG. 20).

Flow diverter 812 comprises a first angled side or panel 813 and a second angled side or panel 815, both of which extend downwardly at a predetermined angle from an apex 816. Extending downwardly from apex 816 at an angle greater than 0° from the plane perpendicular to back wall 814 and less than 90° from that same plane is a spine 840 which ends at the plane of bottom wall 817 (if there is a bottom wall 817; otherwise spine 840 would end at a plane parallel to the lower horizontal walls of tubes 806) and at or near the opening of plurality of parallel tubes 802. To this effect, spine 840 causes sides 813 and 815 to be angled outwardly to direct fluid flow towards exterior tubes 818 as well as inwardly (since they have an inclined angle) so as to direct fluid flow inwardly towards interior flow tubes 806. A drain plug (not shown) would be located either between flow diverter 812 and the ports to flow tubes 806 or alternatively through flow diverter 812.

To reiterate, if header receives hot coolant, coolant fluid flows downwardly from a heat source (not shown) through nozzle 827 and into header 804 to be cooled by heat transfer with ambient fluid via flow tubes 802. Exterior tubes 808 have greatest potential for heat transfer due to the absence of competing proximate flow tube on one side. Flow diverter 812 serves to direct fluid flow towards exterior flow tubes 808 while maintaining sufficient flow to interior tubes 806, thereby affecting a greater heat transfer efficiency in keel cooler 800 by providing adequate fluid flow to exterior tubes 808. Fluid is directed into exterior flow tubes 808 by flow diverter 812 by way of orifices 820. By employment of flow diverter 812, a coolant fluid is more equally distributed throughout keel cooler 800, and therefore more efficient heat transfer is achieved by keel cooler 800.

Figure 20:
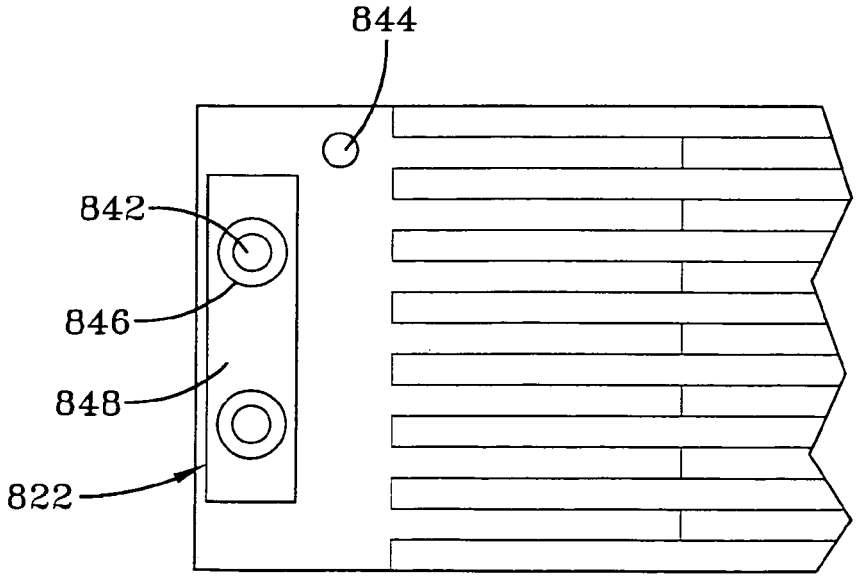
FIG. 20 is a partial bottom view of the apparatus as shown in FIGS. 19 and 19A.

It should be appreciated that flow diverter 812 can also be employed within a keel cooler having a header angled in two directions defined by the contour of panels 813 and 815, rather than a rectangular header as described herein, as shown in FIG. 2, which has the same numerical designations as FIG. 20, but lacking the lower portion of back wall 814. In most instances, it is preferred to omit back wall 814 for reasons of economy and more effective heat transfer. A keel cooler having a beveled header is described in the patent being issued based on U.S. application Ser. No. 09/427,166 (Leeson et al.). As stated in that patent application, the keel cooler with the beveled header serves to direct fluid flow into the interior flow tubes in a more efficient manner. However, a beveled header may not in all instances provide fluid flow to the exterior tubes in as efficient of a manner as would employment of a flow diverter. Therefore, employing the flow diverter with the beveled in two (or more, as described below) directions header could provide in some instances the most efficient fluid flow to both the interior and exterior flow tubes and could provide an improved amount of heat transfer.

Figure 19A:
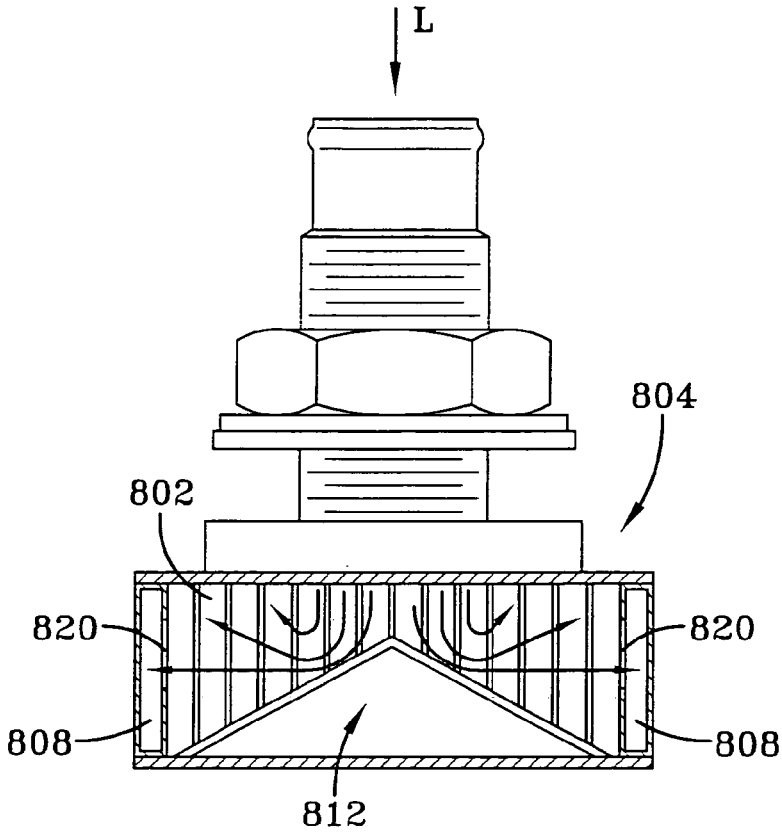
FIG. 19A is a rear view of a partially cut-away header and a portion of the coolant flow tubes of a one-piece keel cooler according to an alternative version of the second embodiment of the present invention showing flow lines of the ambient fluid.

The advantages of employing flow diverter 812 as part of header 804 are demonstrated in FIG. 19A. As shown, coolant fluid is directed downwardly (or upwardly) as is demonstrated via flow arrow L. Coolant, when flowing in a downwardly direction, strikes flow diverter 812 and is urged towards opposite sides of header 804 in the direction of exterior flow tubes 808, as well as forwardly towards tubes 806. Due to flow diverter 812 being angled in the direction of flow tubes 802 and in the direction of exterior tubes 808, ambient fluid is simultaneously and evenly directed towards both sets of tubes, as it shown by the additional flow lines.

In addition to the flow diverter described above, a variety of other alternative designs of flow diverters could be employed in the header of the present invention. The main objective of the flow diverter is to facilitate coolant flow towards both the exterior flow tubes and the interior flow tubes. Therefore, it should be appreciated that a flow diverter having different particular designs can essentially be employed as long as the desired effect of coolant flow diversion is achieved. Various other designs contemplated by the present invention will now be described in the following Figures; however it should also be appreciated that these designs do not encompass all the possible alternative designs that are possible but are simply just a set of examples and additional alternatives can also be employed. Moreover, each of the alternative designs for the flow diverters according to the present invention are shown in a standing alone form for the sake of explanation rather than being employed in header of a keel cooler.

Figure 21:
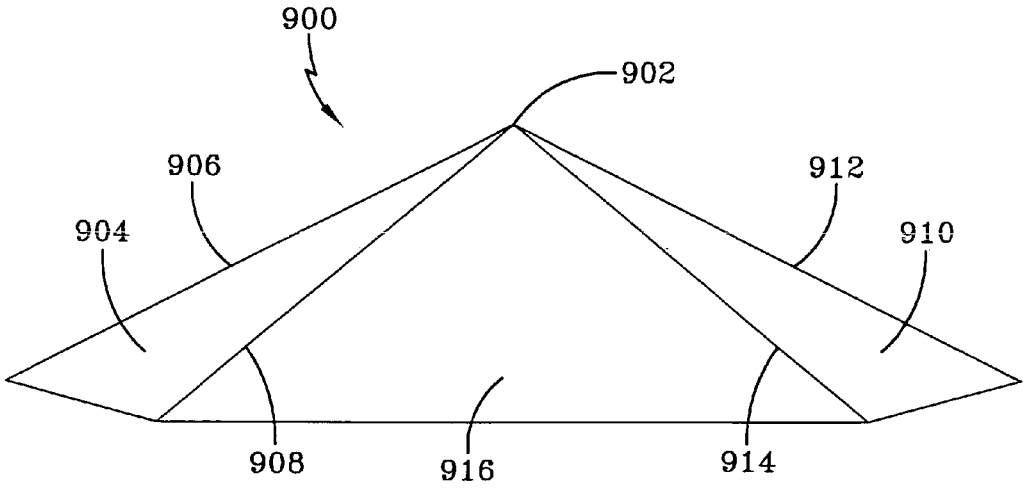
FIG. 21 is a front view of an alternative embodiment of the flow diverter as shown in FIG. 20.

Turning now to FIG. 21, an alternative embodiment of the flow diverter of the present invention is shown and referred to as numeral 900. Flow diverter 900 comprises an apex 902 that is connected to the end wall of the header (not shown) if there is one, otherwise diverter 900 is the end wall. A first panel 904 having a first edge 906 and a second edge 908 extends downwardly and outwardly from apex 902 at a predetermined angle inclined towards an exterior flow tube (not shown). Edges 906 and 908 are not parallel; but rather extend outwardly from apex 902 in a manner so that the lowermost portion of panel 904 is wider than the uppermost portion at apex 902. A second panel 910 having a first edge 912 and a second edge 914 extends outwardly and downwardly from apex 902, but inclined towards the orifice of a second exterior flow tube (not shown) disposed opposite from the aforementioned first exterior flow tube and in the same manner as panel 904. Panel 910 of course may extend from apex 902 at the same angle as panel 904; or it may extend at a greater angle or a smaller angle. A third panel 916 extending between edge 908 and edge 914 extends downwardly from apex 902 and is perpendicular with the floor of the header (now shown), (or with the plane of the lower horizontal walls of tubes 806). Alternatively, flat wall 916 can be angled towards interior flow tubes (not shown) at any desired angle, but ensuring that coolant flow is maintained into and through interior flow tubes (not shown). Third panel 916 directs flow either from an inlet nozzle (not shown) to the inlet ports of flow tubes (not shown) or from flow tubes (not shown) towards an outlet nozzle.

Figure 22:
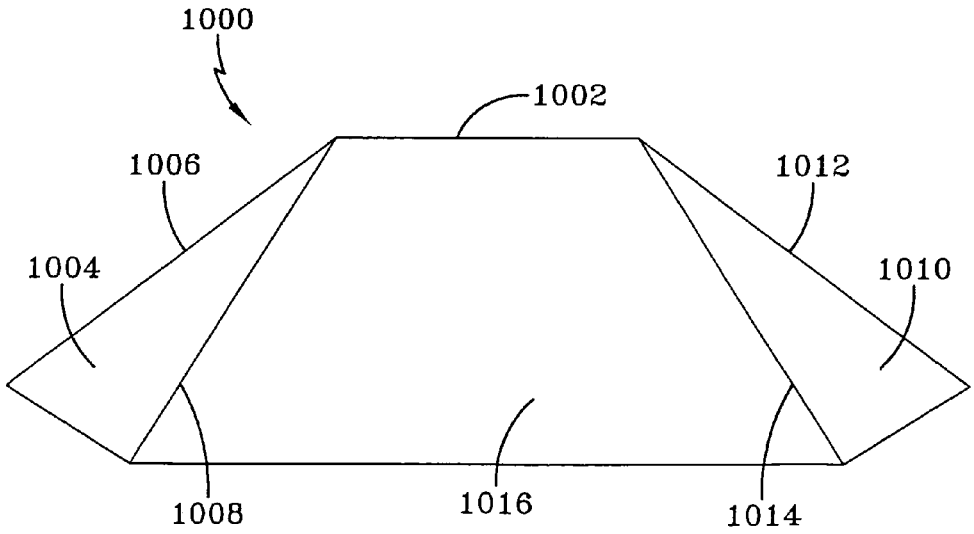
FIG. 22 is a front view of another alternative embodiment of the flow diverter as shown in FIG. 20.

FIG. 22 illustrates yet another embodiment of the flow diverter of the present invention, which is referred to as numeral 1000. Flow diverter 1000 comprises an apex 1002 which is connected to the back wall (not shown) of the header. In this embodiment, apex 1002 is in the form of a spine which extends horizontally along the end wall. In most instances, it is preferred that flow diverter 1000 forms the end wall. A first panel 1004 having a first edge 1006 and a second edge 1008 extends downwardly and outwardly from apex 1002 at a constant (although it can vary), predetermined angle inclined towards the orifice of an exterior flow tube (not shown). Edges 1006 and 1008 are not parallel; but rather extend outwardly from apex 1002 in a manner so that the lowermost portion of panel 1004 is wider than the uppermost portion at apex 1002. A second panel 1010 having a first edge 1012 and a second edge 1014 extends outwardly and downwardly from apex 1002, but towards a second exterior flow tube (not shown) disposed opposite from the aforementioned first exterior flow tube and in the same manner as panel 1004. Panel 1010 of course may extend from apex 1002 at the same angle as panel 1004; or it may extend at a greater angle or a smaller angle. A third panel 1016 extending between edge 1008 and edge 1014 extends downwardly from apex 1002 and is connected with the floor of the header (not shown). Third panel 1016 is angled towards interior flow tubes (not shown) at the desired angle required so that coolant flow is maintained into and through interior flow tubes (not shown). Third panel 1016 directs flow either from a nozzle (not shown) to the inlet ports of flow tubes (not shown) or from flow tubes (not shown) towards the nozzle.

Figure 23:
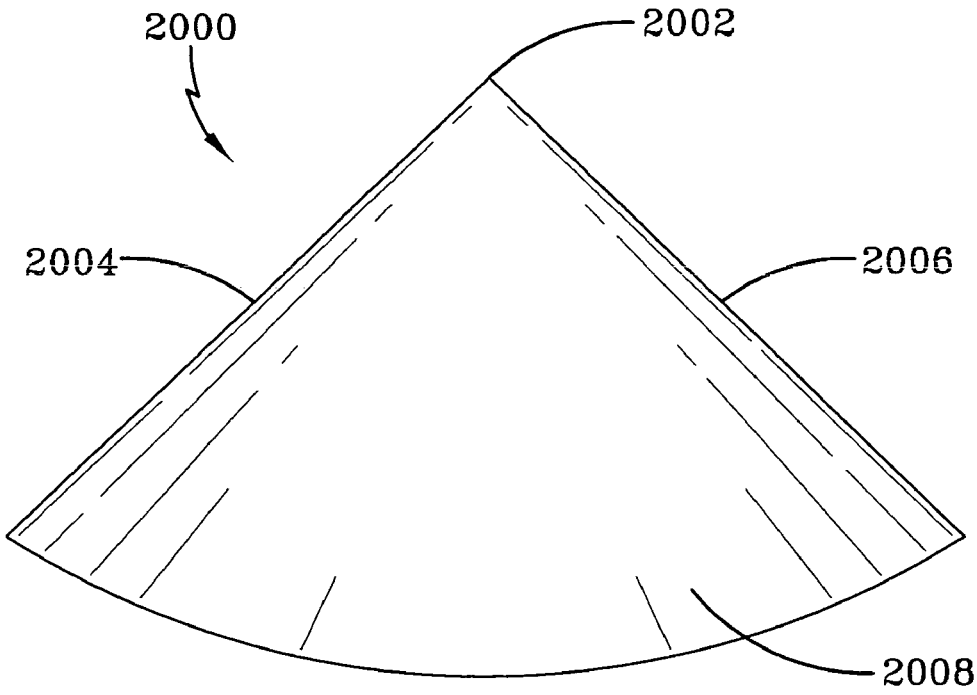
FIG. 23 is a front view of yet another alternative embodiment of the flow diverter as shown in FIG. 20.

Yet another embodiment of the flow diverter according to the present invention is shown and referred to generally as numeral 2000 in FIG. 23. In this embodiment, flow diverter 2000 comprises an apex 2002 that is secured to the end wall (not shown), if one is provided, of the keel cooler header. A first edge 2004 and a second edge 2006 are also connected to the back wall of the header and extend outwardly therefrom at an advantageous distance. Edges 2004 and 2006 are connected by a concave wall 2008 (bowed away from the interior flow tubes), which extends from apex 2002 to the floor of the header (not shown) (or to a plane parallel with the lower horizontal walls of tubes), or it could comprise the floor. Concave wall 2008 is curved such that it is able to facilitate the flow of coolant towards both exterior flow tubes (not shown) and interior flow tubes (not shown) in a substantially uniform manner.

Figure 24:
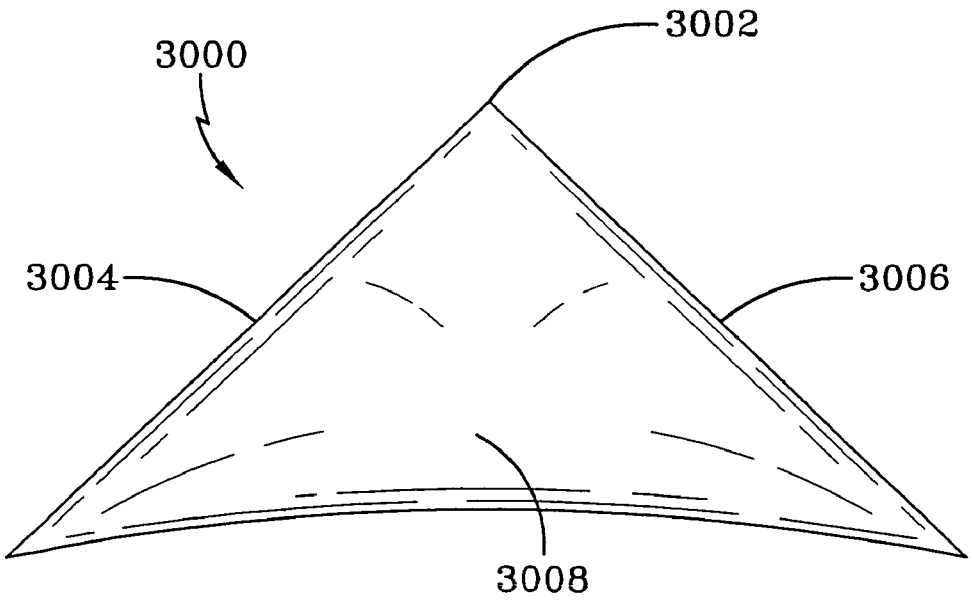
FIG. 24 is a front view of a further alternative embodiment of the flow diverter as shown in FIG. 20.

Turning now to FIG. 24, still yet another embodiment of the flow diverter according to the present invention is shown and referred to at numeral 3000. In this embodiment, flow diverter 3000 comprises an apex 3002 that is secured to the end wall (not shown), if one exists, of the keel cooler header. A first edge 3004 and a second edge 3006 are also connected to the end wall of the header (or else the edges of the end wall, if diverter 3000 is the end wall) and extend outwardly therefrom at an advantageous distance. Edges 3004 and 3006 are connected by a convex wall 3008 (bowed towards the interior flow tubes), which extends from apex 3002 to the floor of the header (not shown). Convex wall 3008 is curved such that it also is able to facilitate the flow of coolant towards both exterior flow tubes (not shown) and interior flow tubes (now shown) in a substantially uniform manner.

Figure 25:
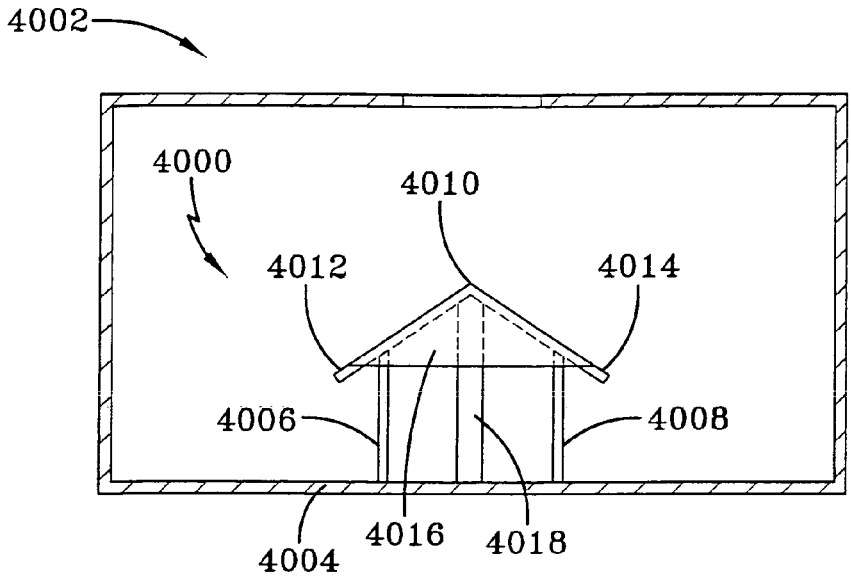
FIG. 25 is a front view of still a further alternative embodiment of the flow diverter as shown in FIG. 20.
Figure 26:
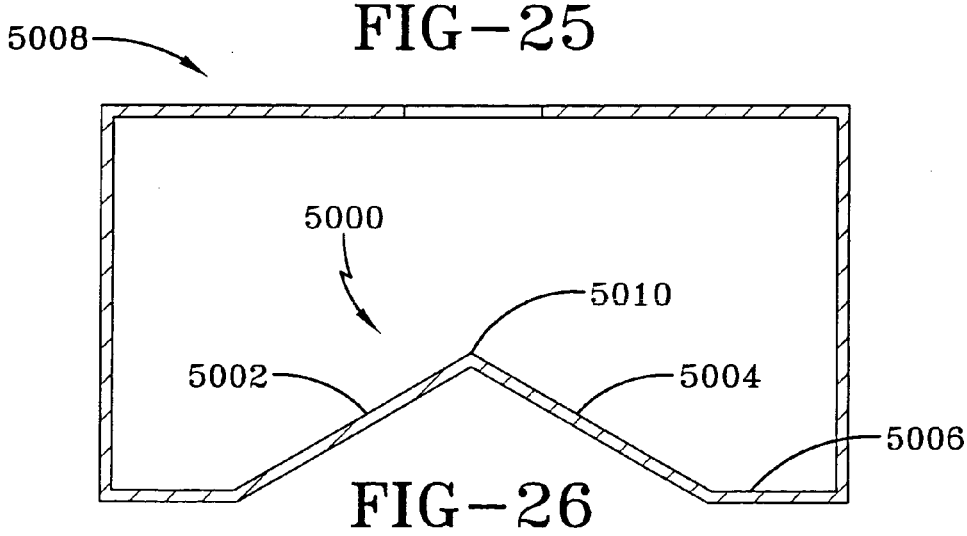
FIG. 26 is a front view of still another alternative embodiment of the flow diverter as shown in FIG. 20.

Referring now to FIG. 25, another design of a flow diverter contemplated by the present invention is shown and referred to at numeral 4000. For perspective purposes, FIGS. 25–26 show the alternative designs for the flow diverter in the context of a keel cooler header. In this instance, flow diverter 4000 is located in a keel cooler header 4002 having a floor 4004. Flow diverter 4000 is secured to floor 4004 by any conventional method known in the art. Flow diverter 4000 comprises a first wall 4006 and a second wall 4008 which extends upwardly from floor 4004 at substantially right angles. Situated atop both walls 4006 and 4008 is a cap 4010 comprising a first panel 4012, a second panel 4014 and a third panel 4016 (there are two panels 4016, one for each orifice for the two exterior tubes). Flow diverter 4000 is strategically disposed directly inline with the flow of incoming coolant so that the flow diverter can effectively divert coolant flow towards the exterior flow tubes (not shown) and the interior flow tubes (not shown). Walls 4012, 4014 and 4016 are angled downwardly and outwardly so that walls 4012 and 4014 direct coolant flow towards orifices to the exterior flow tubes and wall 4016 directs coolant flow towards the interior flow tubes. In addition, a support post 4018 can be employed inside flow diverter 4000 and underneath cap 4010 so that support post extends from floor 4004 to the underside of cap 4010 for providing support to cap 4010 during its exposure to the downward force created by coolant flow.

Turning now to FIG. 26, a flow diverter is shown and referred to at numeral 5000. In this instance, flow diverter comprises a first wall 5002 and a second wall 5004; both of which extend upwardly from a floor 5006 of a keel cooler header 5008 and meet at an apex 5010. In this instance, flow diverter 5000 is simply an upward extension of floor 5006. In other words, flow diverter 5000 can be formed by punching or stamping the underside of floor 5006 so that floor 5006 is pushed upward creating flow diverter 5000. It is configured to direct coolant from the nozzle directly to the interior flow tubes and the orifices of the exterior flow tubes, or vice versa.

Figure 27:
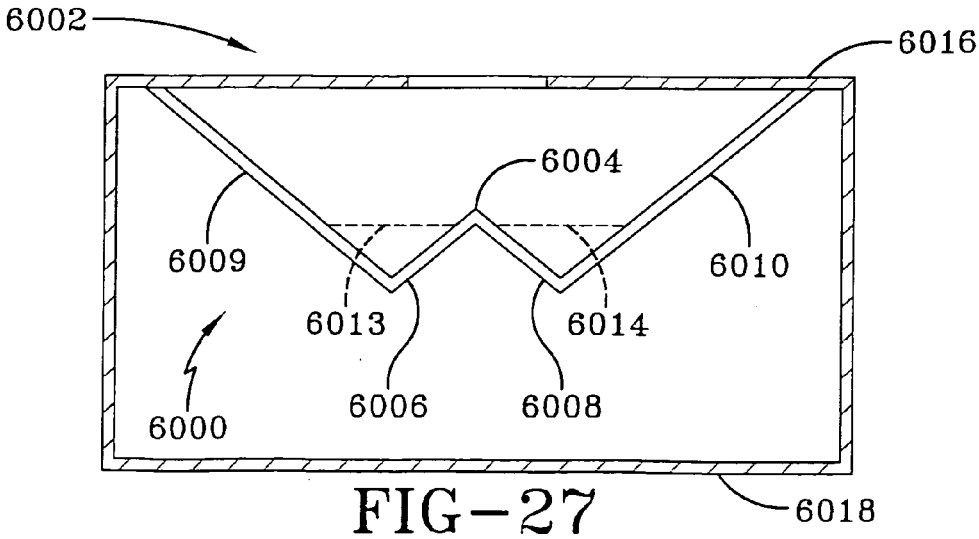
FIG. 27 is a front view of another alternative embodiment of the flow diverter as shown in FIG. 20.

Lastly, FIG. 27 depicts an additional embodiment of the flow diverter according to the present invention, which is referred to at numeral 6000. In this alternative embodiment, the flow diverter is shown in a keel cooler header 6002 having a floor 6018 and a roof 6016. Flow diverter 6000 comprises an apex 6004, from which extend a first wall 6006 and a second wall 6008. For example, the flow diverter can have the same general construction as flow diverter 4000 (FIG. 25) or flow diverter 5000 (FIG. 26). In this instance, however, flow diverter 6000 also includes a first support 6009 and a second support 6010. Supports 6009 and 6010 extend downwardly from roof 6016 and connect directly to sides 6006 and 6008 respectively to so that flow diverter 6000 is suspended within header 6002. Alternatively, supports 6009 and 6010 can connect to a first horizontal member 6013 and a second horizontal member 6014, respectively, which in turn are secured to sides 6006 and 6008, respectively. Because employment of horizontal members 6013 and 6014 are simply alternatives, they are illustrated by dotted lines. As coolant flows into header 6002 from a nozzle (not shown), coolant flows onto flow diverter 6000 where it is diverted in substantially equal amounts towards both the exterior flow tubes and the interior flow tubes (not shown).

The keel coolers described above show nozzles for transferring heat transfer fluid into or out of the keel cooler by directing the heat transfer fluid generally directly into or out of the interior flow tubes and the orifices between the exterior flow tubes and the header. However, there are other means for transferring fluid into or out of the keel cooler besides the nozzles described above; for example, in flange-mounted keel coolers, there are one or more conduits such as pipes extending from the hull and from the keel cooler having end flanges for connection together to establish a heat transfer fluid flow path. Normally a gasket is interposed between the flanges. There may be other means for connecting the keel cooler to the coolant plumbing system in the vessel. This invention is independent of the type of connection used to join the keel cooler to the coolant plumbing system.

The forms of the invention discussed above involve various structure having surfaces for directing the heat exchange fluid in a relatively direct flow between the flow tubes and the header. It should be understood that the diverting apparatus for diverting the heat exchange fluid flow can be located on one or more of the interior surfaces of the walls defining the header. Where the header is composed of an upper wall, a bottom wall having an end portion (or an end wall), an inclined surface and sidewalls, the flow-diverting surfaces can form a part of (and could for the entire) one or more of the interior surfaces.

The invention has been described with particular reference to the preferred embodiments thereof, but it should be understood that variations and modifications within the spirit and scope of the invention may occur to those skilled in the art to which the invention pertains.

What is claimed is:

1. A header for a heat exchanger, the heat exchanger having a plurality of parallel tubes having generally rectangular cross sections, the tubes including a pair of outermost tubes and at least one inner tube located between the outermost tubes, the at least one inner tube having coolant ports and the outermost tubes respectively comprising an outer wall and a parallel inner wall, each of the inner walls having an orifice in the header for access to the outermost tubes, said header comprising:

an upper wall having an end portion, opposing side portions, an inner portion and an inlet/outlet opening for permitting the flow of coolant between an inlet/outlet and said header;

a bottom wall having an end portion, opposing side portions and an inner portion;

an inclined surface extending between the inner portions of said bottom wall and said upper wall, and including the open end(s) of the at least one inner tube to said header;

a flow diverter comprising a spine inclined from a first position near the upper wall to a second position near said bottom wall, closer to said inclined surface than said first position and having an apex located at the top of said spine near said upper wall; said flow diverter having diverting first and second panels extending downwardly in opposite radial directions from said apex and on opposite sides of said spine at respective angles towards the respective outermost tubes and respectively ending at the inner portion of said bottom wall, said first panel and said second panel having beveled surfaces inclined towards the at least one inner tube and towards the respective orifices to the respective outermost tubes for facilitating flow of coolant between said inlet/outlet and said pair of outermost tubes and into said at least one inner tube; and sidewalls extending between the side portions of said upper wall and said bottom wall;

said sidewalls, upper wall, flow diverter, bottom wall and inclined surface forming a header chamber;

said respective orifice being disposed at least partly over said inclined surface and at least partly beneath said inlet/outlet opening.

2. A header according to claim 1 and further comprising an end wall interconnecting the end portions of said upper wall and of said bottom wall, said end wall being perpendicular to both of said upper wall and said bottom wall.

3. A header according to claim 1 wherein each of said first panel and said second panel of said flow diverter extends from said apex and said spine radially at an angle greater than 0° and less than 90° and are inclined at the same angle of inclination towards said plurality of tubes as said spine.

4. A header according to claim 3 wherein said first panel and said second panel of said flow diverter extend from said apex and said spine radially at the same angle.

5. A header according to claim 3 wherein said first panel and said second panel of said flow diverter extend from said apex and said spine radially at different angles.

6. A heat exchanger having at least one header, said heat exchanger having a plurality of parallel tubes having generally rectangular cross sections, the tubes including a pair of outermost tubes and at least one inner tube located between the outermost tubes, the at least one inner tube having coolant ports, said header comprising:

an upper wall having an end portion, opposing side portions, an inner portion and an inlet/outlet opening for permitting the flow of coolant fluid between an inlet/outlet and said header;

a bottom wall having an end portion, opposing side portions and an inner portion;

an inclined surface extending between an intersection with the inner portions of said bottom wall and an intersection with said upper wall, and including the open end(s) of the at least one inner tube to said header;

a flow diverter disposed in said header comprising a spine extending downwardly at a predetermined angle from an apex located at the top of said spine and having a first panel and a second panel, each of said panels extending downwardly in a radial direction from said apex and said spine at opposite angles and ending at an intersection with the inner portion of said bottom wall, and whereby said first panel and said second panel are additionally angled surfaces being angled towards said plurality of parallel tubes; and sidewalls extending between the side portions of said upper wall and said bottom wall, said sidewalls being extensions of the outermost tubes of the heat exchanger, said outermost tubes including an outer wall and an inner wall;

said sidewalls, upper wall, flow diverter, and bottom wall between the intersections of the flow diverter and bottom wall and the inclined surface and bottom wall, and inclined surface forming a header chamber;

said inner walls of said sidewalls each having an orifice for permitting the flow of coolant fluid between said header chamber and the respective outermost tube, said respective orifice being disposed at least partly over said inclined surface and at least partly beneath said inlet/outlet opening.

7. A header according to claim 6 and further comprising an end wall interconnecting the end portions of said upper wall and of said bottom wall, said end wall being perpendicular to both of said upper wall and said bottom wall.

8. A header for a heat exchanger, the heat exchanger having a plurality of tubes, the tubes including a pair of outermost tubes and at least one inner tube located between the outermost tubes, the at least one inner tube having coolant ports and the outermost tubes respectively comprising an outer wall and a parallel inner wall, each of the inner walls having an orifice in the header for access to the outermost tubes, said header comprising:

an upper wall having an end portion, opposing side portions, an inner portion and an inlet/outlet opening for permitting the flow of coolant between an inlet/outlet and said header;

a bottom wall having an end portion, opposing side portions and an inner portion;

an inclined surface extending between the inner portions of said bottom wall and said upper wall, and including the open end(s) of the at least one inner tube to said header;

a flow diverter comprising a spine inclined from a first position near the upper wall to a second position near said bottom wall, closer to said inclined surface than said first position and having an apex located at the top of said spine near said upper wall; said flow diverter having diverting first and second panels extending downwardly in opposite radial directions from said apex and on opposite sides of said spine at respective angles towards the respective outermost tubes, said first panel and said second panel having beveled surfaces inclined towards the at least one inner tube and towards the respective orifices to the respective outermost tubes for facilitating flow of coolant fluid between said inlet/outlet and said pair of outermost tubes and into said at least one inner tube; and sidewalls extending between the side portions of said upper wall and said bottom wall;

said sidewalls, upper wall, flow diverter, bottom wall and inclined surface forming a header chamber.

9. A header according to claim 8 and further comprising an end wall interconnecting the end portions of said upper wall and of said bottom wall.

10. A heat exchanger having at least one header, said heat exchanger having a plurality of tubes, the tubes including a pair of outermost tubes and at least one inner tube located between the outermost tubes, the at least one inner tube having coolant ports, said header comprising:

an upper wall having an end portion, opposing side portions, an inner portion and an inlet/outlet opening for permitting the flow of coolant between an inlet/outlet and said header;

a bottom wall having an end portion, opposing side portions and an inner portion;

an inclined surface extending between an intersection with the inner portions of said bottom wall and an intersection with said upper wall, and including the open end(s) of the at least one inner tubes to said header;

a flow diverter disposed in said header comprising a spine extending downwardly at a predetermined angle from an apex located at the top of said spine and having a first panel and a second panel, each of said panels extending downwardly in a radial direction from said apex and said spine at opposite angles, and whereby said first panel and said second panel are additionally angled surfaces being angled towards said plurality of parallel tubes; and sidewalls extending between the side portions of said upper wall and said bottom wall, said sidewalls being extensions of the outermost tubes of the heat exchanger, said outermost tubes including an outer wall and an inner wall;

said sidewalls, upper wall, flow diverter, and bottom wall between the intersections of the flow diverter and bottom wall and the inclined surface and bottom wall, and inclined surface forming a header chamber;

said inner walls of said sidewalls each having a port for permitting the flow of coolant between said header chamber and the respective outermost tube.

11. A header according to claim 10 and further comprising an end wall interconnecting the end portions of said upper wall and of said bottom wall.

* * * * *